US006186112B1

(12) United States Patent
Takahashi et al.

(10) Patent No.: US 6,186,112 B1
(45) Date of Patent: Feb. 13, 2001

(54) FUEL SUPPLY APPARATUS FOR INTERNAL COMBUSTION ENGINE

(75) Inventors: Jun Takahashi, Toyota; Masaaki Yano, Aichi-ken; Daichi Yamazaki, Toyota; Masanori Sugiyama, Aichi-ken; Akira Yasuki, Toyota; Ryuji Shibata, Okazaki, all of (JP)

(73) Assignee: Toyota Jidosha Kabushiki Kaisha, Toyota (JP)

( * ) Notice: Under 35 U.S.C. 154(b), the term of this patent shall be extended for 0 days.

(21) Appl. No.: 09/315,137

(22) Filed: May 20, 1999

(30) Foreign Application Priority Data

May 29, 1998 (JP) ..... 10-150287
Dec. 28, 1998 (JP) ..... 10-373902

(51) Int. Cl.[7] ..... F02B 77/00; F02M 41/00
(52) U.S. Cl. ..... 123/198 D; 123/456; 123/468
(58) Field of Search ..... 123/198 D, 456, 123/468, 469, 470, 381; 277/313

(56) References Cited

U.S. PATENT DOCUMENTS 4,384,557 * 5/1983 Johnson ..... 123/198 D
4,445,713 * 5/1984 Bruning ..... 285/14
4,467,757 * 8/1984 Dazzi ..... 123/198 DB
4,469,065 * 9/1984 Hasegawa et al. ..... 123/359
4,621,600 * 11/1986 Hasegawa ..... 123/357
5,617,828 * 4/1997 Kuegel et al. ..... 123/468
5,715,786 * 2/1998 Seiberth ..... 123/198 D
5,727,515 * 3/1998 Biester ..... 123/198 D
5,819,708 * 10/1998 Buratti et al. ..... 123/468
6,009,854 * 1/2000 Rosgren et al. ..... 123/456
6,073,612 * 6/2000 Ohkubo et al. ..... 123/456
6,085,728 * 7/2000 Grosser et al. ..... 123/447
6,119,656 * 9/2000 Schmidt ..... 123/456

FOREIGN PATENT DOCUMENTS 9-126087 5/1997 (JP) .
10-73060 3/1998 (JP) .

* cited by examiner

*Primary Examiner*—Carl S. Miller
(74) *Attorney, Agent, or Firm*—Oliff & Berridge, PLC

(57) ABSTRACT

In order to prevent fuel leakage from a high pressure fuel pipe at a low temperature, a sealing capacity of a seal member provided in a fuel transfer portion of a high pressure fuel pipe is estimated in accordance with various conditions and the fuel pressure within the high pressure fuel pipe is controlled on the basis of the estimated sealing capacity so as to secure a sealing property in the fuel transfer portion.

24 Claims, 18 Drawing Sheets

FUEL SUPPLY APPARATUS FOR INTERNAL COMBUSTION ENGINE

INCORPORATION BY REFERENCE

The disclosure of Japanese Patent Application No. HEI 10-150287 filed on May 29, 1998 and Japanese Patent Application No. HEI 10-373902 filed on Dec. 28, 1998, including the specification, drawings and abstract, are incorporated herein by reference in their entirety.

BACKGROUND OF THE INVENTION

1. Field of the Invention

The present invention relates to a fuel supply apparatus for an internal combustion engine having a high pressure fuel pipe for supplying fuel, which has been pressurized by a high pressure fuel pump, to an injector of the internal combustion engine, and a seal member arranged in a fuel transfer portion of the high pressure fuel pipe for securing a sealing property.

2. Description of the Related Art

A cylinder fuel injection type internal combustion engine is structured to pressurize a fuel in a fuel tank to a high pressure by a supply pump, supply the pressurized fuel to a high pressure fuel pipe formed of a delivery pipe and the like, and directly inject and supply the fuel into a cylinder from the injector connected to the delivery pipe.

Further, fuel pressure within the high pressure fuel pipe, that is, an injection pressure of the fuel injected from the injector is controlled to a pressure suitable for an operating state of the internal combustion engine. For example, the injection pressure is controlled by controlling a discharge amount of the supply pump. In this case, the fuel pressure in the high pressure fuel pipe is normally set to be higher than that of an inlet port of fuel injection type internal combustion engine. This is because the fuel has to be injected against an internal pressure of the highly pressurized cylinder in case of the cylinder fuel injection type internal combustion engine. Further, the fuel spray is required to be atomized to secure a good combustion state.

In the fuel supply apparatus employed in the cylinder fuel injection type internal combustion engine, a seal member like O-ring has been conventionally place at a location where fuel leakage is likely to occur. For example, the O-ring has been placed at a connection portion between the delivery pipe and the injector, a connection portion between the supply pump and the delivery pipe or the like such that sufficient sealing property is obtained. The aforementioned technique is disclosed in Japanese Patent Application Laid-Open No. HEI 9-126087 or Japanese Patent Application Laid-Open No. HEI 10-73060. The technique for securing the sealing property for the connection portion using the seal member is not a complicated operation. Additionally, the O-ring is effective at damping vibrations transmitted to the high pressure fuel pipe from the supply pump.

However, the aforementioned seal member is likely to loose its flexibility and lose sealing ability when exposed to a low temperature. Accordingly, in the fuel supply apparatus using a seal member there has been a risk of leakage of a very small amount of fuel from the connection portion of the high pressure fuel pipe where the seal member is attached. For example, a leak may occur when cold starting the internal combustion engine.

SUMMARY OF THE INVENTION

The present invention provides a fuel supply apparatus for an internal combustion engine which can prevent leakage of a fuel from a high pressure fuel pipe at a low temperature. In accordance with the present invention, there is provided a fuel supply apparatus for an internal combustion engine including a high pressure fuel pipe for supplying a fuel, which has been pressurized by a high pressure fuel pump, to an injector of an internal combustion engine, a seal member for sealing a fuel transfer portion of the high pressure fuel pipe, and fuel pressure controller that estimates a sealing capacity of the seal member and that controls a fuel pressure within the high pressure fuel pipe on the basis of the estimated sealing capacity so that a predetermined sealing property can be maintained at the fuel transfer portion.

In accordance with the structure mentioned above, in the case where the sealing capacity of the seal member is reduced at a low temperature, the fuel pressure within the high pressure fuel pipe is restricted to a level at which the fuel leakage is not generated in accordance with the reduction of the sealing capacity.

Further, in general, the seal member formed by a polymeric material is likely to lose flexibility as the temperature decreases which results in deteriorated sealing capacity.

Accordingly, the fuel pressure controller estimates the sealing capacity of the seal member on the basis of an estimation of the temperature of the seal member. Therefore, it is possible to easily estimate the sealing capacity of the seal member.

Further, the fuel pressure controller reduces the fuel pressure within the high pressure fuel pipe if the estimated temperature of the seal member does not reach a temperature that is capable of securing the sealing capacity of the seal member. Accordingly, it is possible to easily estimate the sealing capacity of the seal member on the basis of the seal member temperature. When the temperature of the seal member is too low to secure the sealing capacity, it is possible to restrict the fuel pressure within the high pressure fuel pipe to a level at which the fuel leakage is not generated.

Still further, when reducing the fuel pressure within the high pressure fuel pipe as mentioned above, the fuel pressure controller may change a rate for reducing the amount of the fuel within the high pressure fuel pipe on the basis of the estimated temperature of the seal member. In accordance with the structure mentioned above, it is possible to set the fuel pressure within the high pressure fuel pipe in accordance with the seal capacity reduction.

Furthermore, since it is generally difficult to directly detect the temperature of the seal member, the fuel pressure controller comprises a detector that detects a state of the internal combustion engine that has a mutual relation to the temperature of the seal member. The fuel pressure controller also compares the detected state with a predetermined value that corresponds to a temperature that is capable of securing a sealing capacity. Thus, the fuel pressure controller reduces the fuel pressure within the high pressure fuel pipe when the comparison indicates that the detected state meets the predetermined judgment. Accordingly, it can be easily determined if the temperature of the seal member does not reach the temperature at which the seal capacity of the seal member is secured, and then the fuel pressure control can be easily realized on the basis of the temperature of the seal member.

Further, as a particular structure for detecting the state of the internal combustion engine mentioned above, the detector detects the temperature of the fuel within the high pressure fuel pipe as the state and the fuel pressure controller determines whether the detected temperature of the fuel is lower than a predetermined temperature corresponding.

Alternatively, the detector detects a temperature the cooling water or the lubricating oil of the internal combustion engine and the fuel pressure controller determines when the detected temperature is lower than a predetermined temperature.

Particularly, in the former case, the fuel within the high pressure fuel pipe is directly brought into contact with the seal member and the fuel temperature has a high mutual relation with respect to the seal member temperature. Therefore, the determination of whether the seal member temperature is low is reliable.

Further, the detector can detect an elapsed time from engine start as the state and the fuel pressure controller determines whether the detected elapsed time is shorter than a predetermined time. Alternatively, the detector detects an additional amount of fuel injected from the injector after engine start or an additional amount of an inlet air supplied to the internal combustion engine after engine start and the fuel pressure controller determines when the detected added amount is less than a predetermined amount.

When the internal combustion engine is started, combustion heat generated within the cylinder is transmitted to the seal member via the high pressure fuel pipe and the fuel flowing within the high pressure fuel pipe, so that the seal member temperature begins to gradually increase. Accordingly, a total amount of the heat received by the seal member is increased in accordance with the increase in the elapsed time from the engine start.

Accordingly, the former case focuses on the relation between the elapsed time from engine start and the increased temperature of the seal member. When the elapsed time is shorter than the predetermined time period, the increased seal member temperature is low. Therefore, when the elapsed time is shorter than the predetermined time period, it can be determined that the seal member temperature increase is low, resulting in a low seal member temperature.

Further, the total amount of the heat received by the seal portion is increased as the total amount of the combustion heat generated within the cylinder after the engine starts increases. Accordingly, the seal member temperature becomes greatly increased.

The latter case focuses on a relation between the total combustion heat and the increased seal member temperature. That is, the total combustion heat generated within the cylinder after engine start has a mutual relation with the fuel injected from the injector and the additional amount of air introduced to the combustion of the injected fuel after engine start. In the case where the additional amount is less than a predetermined amount, it can be determined that the seal member temperature is low because the total combustion heat is small.

Further, in the case where the internal combustion engine is temporarily stopped and immediately restarted after the engine has operated for a predetermined time, the seal member temperature occasionally is higher than the temperature where sealing capacity is expected to be deteriorated at engine start. In order to accurately determine if the seal member temperature is low, it is preferable to detect the initial seal member temperature at engine start in addition to the increase in seal member temperature and determine the seal member temperature based on the detected initial temperature and the increase of the temperature.

As the structure mentioned above, the detector detects the temperature of the fuel within the high pressure fuel pipe at engine start or the temperature of the cooling water or the lubricating oil of the internal combustion engine at engine start as the state and the fuel pressure controller determines when the detected temperature is lower than a predetermined temperature and the detected elapsed time is shorter than a predetermined time. Additionally, the detector further detects the temperature of the fuel within the high pressure fuel pipe at engine start or the temperature of the cooling water or the lubricating oil of the internal combustion engine at engine start as the state and the fuel pressure controller determines when the detected temperature is lower than a predetermined temperature and the detected additional amount is less than a predetermined amount.

In accordance with these structures mentioned above, in the case where sufficient sealing capacity of the seal member has been already achieved at engine start, the pressure of the fuel within the high pressure fuel pipe is not reduced.

Further, being in contact with the fuel, the seal member is swollen by the fuel that has permeated therein. As a result, flexibility of the seal member at a low temperature is increased, thus enhancing the sealing capacity.

Then, the fuel pressure controller can reflect an increase of the seal capacity due to the swell, in view of controlling the fuel pressure within the high pressure fuel pipe to the pressure at which the fuel leakage is not generated, by employing the fuel pressure controller in which the sealing capacity of the seal member is estimated by an estimation of the temperature and the swelling degree.

Further, as a more specific control aspect relating to the fuel pressure control with taking into consideration the increase of the sealing capacity due to the swell mentioned above, there can be employed the structure in which the fuel pressure controller reduces the fuel pressure within the high pressure fuel pipe when the estimated temperature of the seal member does not reach a temperature capable of securing the sealing capacity of the seal member and the estimated seal member swelling does not reach the degree capable of securing the sealing capacity of the seal member, and the structure in which the fuel pressure controller reduces the fuel pressure within the high pressure fuel pipe when the estimated seal member temperature does not reach a temperature capable of securing the sealing capacity of the seal member or when the estimated seal member swelling does not reach a degree capable of securing the sealing capacity of the seal member.

DETAILED DESCRIPTION OF PREFERRED EMBODIMENTS

Hereinafter, a first embodiment of a fuel supply apparatus in accordance with the present invention will be described hereinafter.

Figure 1:
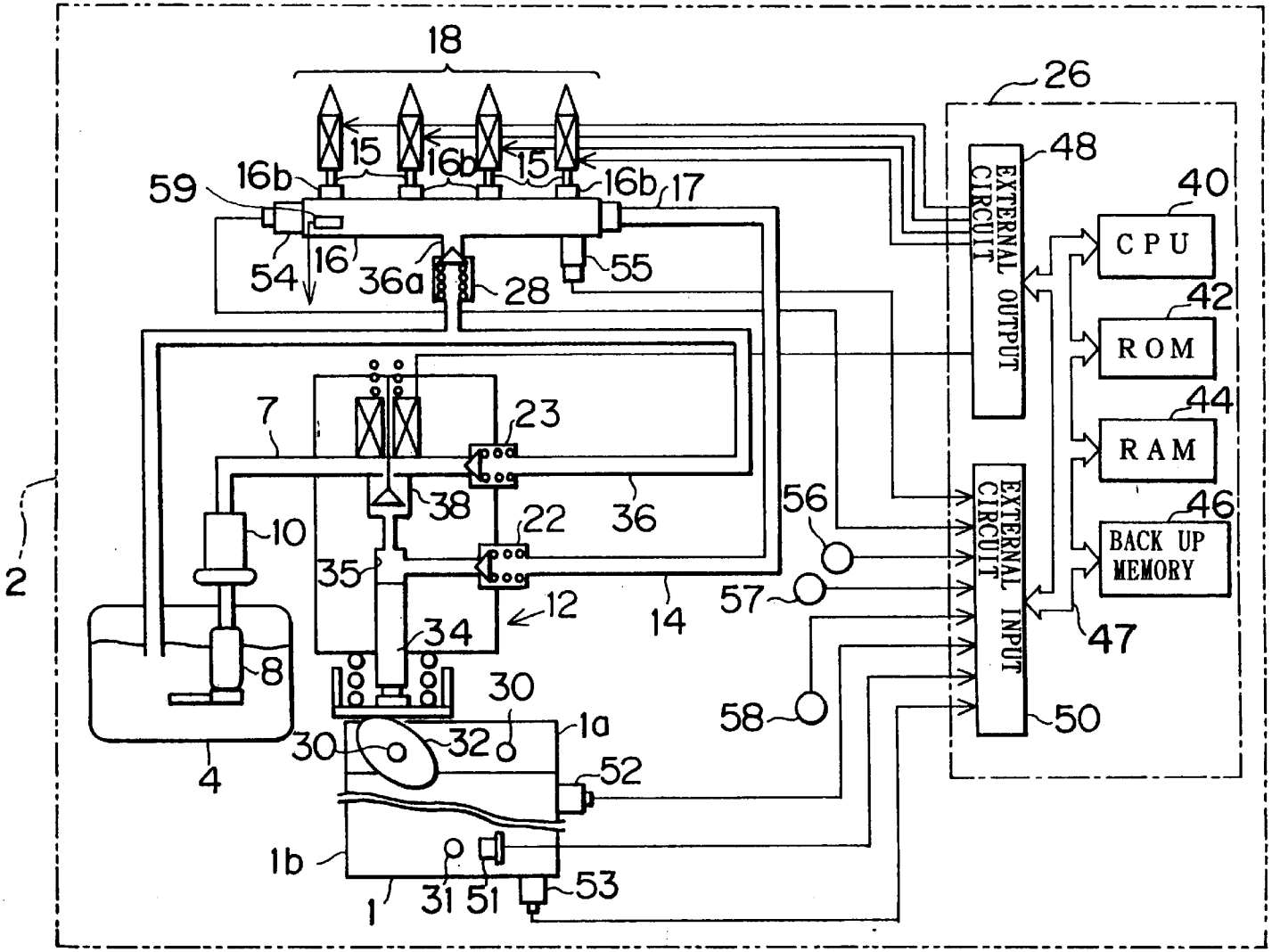
FIG. 1 is a schematic view of a fuel supply apparatus.

FIG. 1 is a schematic view showing a cylinder fuel injection type 4-cylinder gasoline engine 1 mounted on a vehicle 2 and a fuel supply apparatus for the engine 1.

The fuel supply apparatus is formed of a fuel tank 4 for storing a fuel, a supply pump 12 for pressurizing the fuel to a high pressure, a feed pump 8 for pressure feeding the fuel in the fuel tank 4 to the supply pump 12, a delivery pipe 16 for distributing the fuel pressurized in the supply pump 12 to each of injectors 18 of the engine 1, an electric control unit (hereinafter, referred to as an ECU) 26 for controlling a pressure feed amount of the supply pump 12 and the like.

The injector 18 is provided in a cylinder head 1*a* of the engine 1 so that a front end portion to which the fuel is injected is positioned within each cylinder (not shown), and is connected to the delivery pipe 16 at a fuel introduction portion 15 formed in a base end portion thereof. A fuel injection pressure of the injector 18 is set on the basis of fuel pressure within the delivery pipe 16.

Figure 2:
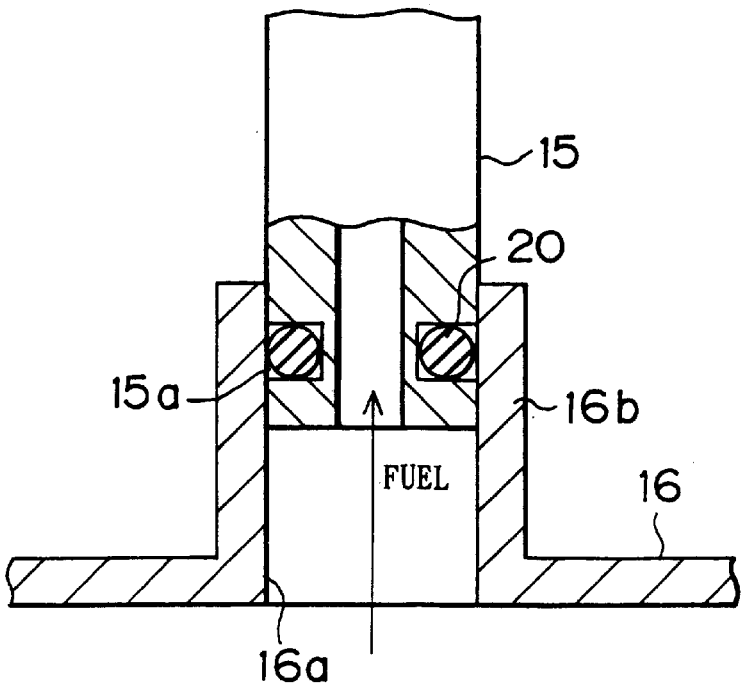
FIG. 2 is an enlarged cross sectional view of a connection portion between a delivery pipe and an injector.

FIG. 2 is an enlarged cross sectional showing a connection portion between the fuel introduction portion 15 and the delivery pipe 16.

Four distribution ports 16*a* (only one of them is illustrated in FIG. 2) are formed in a side portion of the delivery pipe 16. A cylindrical connection portion 16*b* is formed on a periphery of each of the fuel distribution ports 16*a*, and an end portion of the fuel introduction portion 15 is inserted into the connection portion 16*b*.

A peripheral groove 15*a* is formed in an end portion of the fuel introduction portion 15 covered by the connection portion 16*b*, and an O-ring 20 made of a polymer material such as a fluoro rubber is disposed within the peripheral groove 15*a*. The O-ring 20 seals between an outer wall of the fuel introduction portion 15 and an inner wall of the connection portion 16*b*, thus securing a sealing property (a fluid tight property) in the connection portion between the injector 18 and the delivery pipe 16.

As shown in FIG. 1, the feed pump 8 is a power driven pump fixed to an inner portion of the fuel tank 4, and a discharge port is connected to the supply pump 12 via a low pressure fuel supply passage 7 provided with a fuel filter 10 in the middle thereof. Fuel within the fuel tank 4 pumped up by the feed pump 8 is supplied to the supply pump 12 after passing through the low pressure fuel supply passage 7.

The supply pump 12 is provided in the cylinder head la and is provided with a pressure chamber 35 to which the fuel is introduced through the low pressure fuel supply passage 7, a plunger 34 for pressurizing the fuel within the pressure chamber 35 to a high pressure reciprocated by means of a pump cam 32 provided in a cam shaft 30, a control valve 38 for adjusting the amount of the fuel discharged from the pressure chamber 35 and the like.

The pressure chamber 35 is connected to the fuel tank 4 via a relief passage 36 and connected to the delivery pipe 16 via a high pressure fuel passage 14. A check valve 22 for restricting the inflow of the fuel into the pressure chamber 35 from the delivery pipe 16 is provided in the high pressure fuel passage 14.

Figure 3:
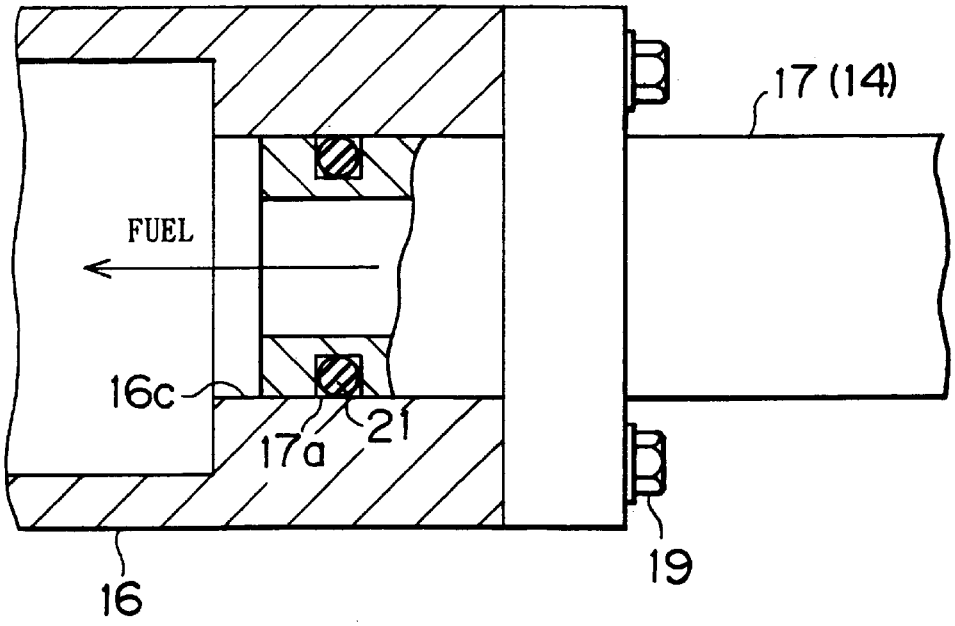
FIG. 3 is an enlarged cross sectional view of a connection portion between the delivery pipe and a fuel supply pipe.

FIG. 3 is an enlarged cross sectional view showing a connection portion between the fuel supply pipe 17 and the delivery pipe 16 constituting a part of the high pressure fuel passage 14.

A fuel introduction port 16*c* is formed in an end portion of the delivery pipe 16. The fuel supply pipe 17 is fixed to the delivery pipe 16 with a plurality of bolts 19 such that an end portion thereof is inserted to the fuel introduction port 16*c*. A peripheral groove 17*a* is formed in an end portion of the fuel supply pipe 17 covered by an inner wall of the fuel introduction port 16*c*, and an O-ring 21 made of a polymer material such as a fluoro rubber is arranged within the peripheral groove 17*a*. The O-ring 21 seals between the outer wall of the fuel supply pipe 17 and the inner wall of the fuel introduction port 16*c*, thus securing a sealing property in the connection portion between the fuel supply pipe 17 and the delivery pipe 16.

As shown in FIG. 1, a pressure regulator 23 for keeping fuel pressure introduced within the pressure chamber 35 from the feed pump 8 at a fixed is provided in the relief passage 36. The relief passage 36 is also connected to the delivery pipe 16, and a relief valve 28 is provided in a connection portion 36*a* of the relief passage 36. The relief valve 28 opens when the fuel pressure within the delivery pipe 16 becomes excessive so as to return the fuel within the delivery pipe 16 to the fuel tank 4 through the relief passage 36, thus reducing the fuel pressure.

A control valve 38 is a solenoid valve which is opened and closed in synchronous with a rotation of a cam shaft 30. When the control valve 38 is open, the pressure chamber 35 communicates with the low pressure fuel supply passage 7 and the relief passage 36. On the contrary, when the valve 38 is closed, communication between the pressure chamber 35 and the passages 7, 36 is shut down.

Next, a pressure feed of the supply pump 12 will be described below.

In an intake stroke in which the plunger 34 moves down in accordance with the rotation of the cam shaft 30, the control valve 38 is always kept in an open state. Accordingly, the fuel pressure fed from the feed pump 8 is introduced within the pressure chamber 35 through the low pressure fuel supply passage 7.

Next, in a pressurizing stroke in which the plunger 34 moves up, the volume of the pressure chamber 35 is reduced in accordance with the upward movement. Here, in the case where the control valve 38 is kept in the open state, the fuel in the pressure chamber 35 is returned to the fuel tank 4 through the relief passage 36. On the contrary, when the control valve 38 is switched from the open state to the closed state at a predetermined timing during the pressurizing stroke, communication of the pressure chamber 35 with the low pressure fuel supply passage 7 and the relief passage 36 is shut down. As a result, the fuel in the pressure chamber 35 pressurized by the plunger 34 is fed to the delivery pipe 16 through the high pressure fuel passage 14.

The fuel pressure from the supply pump 12 is adjusted on the basis of the timing when the control valve 38 is switched from the open state to the closed state in the pressurizing stroke (hereinafter, referred to as a pressure feed start timing). For example, when the pressure feed start timing is advanced, a time for pressure feeding the fuel becomes long, thus increasing the fuel pressure. On the contrary, when the pressure feed start timing is retarded, the fuel feeding time is short, thus decreasing the fuel pressure.

An adjustment of the fuel pressure is executed by the ECU 26. That is, the ECU 26 calculates a target fuel pressure within the delivery pipe 16 (a target fuel pressure PFTRG) on the basis of the operation state of the engine 1 and compares the target fuel pressure PFTRG with an actually detected pressure of the fuel within the delivery pipe 16. Then, when the ECU 26 determines that the fuel pressure PF is lower than the target fuel pressure PFTRG (PF<PFTRG), the ECU 26 advances the pressure feed start timing. On the contrary, when the ECU 26 determines that the fuel pressure PF is higher than the target fuel pressure PFFRG (PF>PFTRG), the ECU 26 retards the pressure feed start timing. The fuel pressure is adjusted in the aforementioned manner, whereby the fuel pressure within the delivery pipe 16, that is, the fuel injection pressure of the injector 18 will be controlled to a pressure corresponding to the operation state of the engine 1.

In addition to controlling the fuel pressure within the delivery pipe 16 as mentioned above, the ECU 26 controls the timing and a fuel injection amount (a fuel injection amount Q) and various kinds of controls in the engine 1 such as an ignition timing. The ECU 26 is provided with a central processing unit (CPU) 40, a read only memory (ROM) 42 preliminarily storing a predetermined program, function data and the like, a random access memory (RAM) 44 temporarily storing calculation results of the CPU 40 and the like, a back up memory 46 for storing data after the engine stops. Further, the ECU 26 is provided with an external output circuit 48 for outputting a drive signal to the injector 18, the control valve 38 and the like, an external input circuit 50 to which the signals detected from the various kinds of sensors are input and the like. These portions 40 to 46 are connected to the external output circuit 48 and the external input circuit 50 via a bus 47.

Various kinds of sensors used for the control by the ECU 26 mentioned above are provided in the engine 1 and the delivery pipe 16.

A rotational speed sensor 51 for detecting rotational speed of the crank shaft 31 per a unit time, that is, a rotational speed NE of the engine is provided near the crank shaft 31 of the engine 1. A water temperature sensor 52 for detecting a temperature of the cooling water (a cooling water temperature THW) of the engine 1 and an oil temperature sensor 53 for detecting a temperature of a lubricating oil (a lubricating oil temperature THO) supplied to a sliding portion such as the crank shaft 31 and the like are provided in a cylinder block 1*b* of the engine 1. In the delivery pipe 16, a fuel pressure sensor 54 for detecting the fuel pressure PF and a fuel temperature sensor 55 for detecting the fuel temperature (the fuel temperature THF) within the delivery pipe 16 are provided. Signals detected by these various kinds of sensors 51 to 55 are all input to the external input circuit 50 of the ECU 26.

Further, in the engine 1, there is provided an ignition switch 56 operated by a driver for starting and stopping the engine. The ignition switch 56 outputs an ignition signal IG to the external input circuit 50.

For example, the ignition switch 56 outputs the ignition signal IG corresponding to "ON" when the switched position is at an on position and the engine 1 is operated, and outputs the ignition signal IG corresponding to "OFF" to the external input circuit 50 when the switched position is at an off position and the engine 1 is in a stopped state.

In this connection, when the switched position of the ignition switch 56 is switched to the off position in the manner mentioned above, a power supply from a battery (not shown) to the ECU 26 is shut off after the elapse of a predetermined time, and all the processes by the ECU 26 are stopped.

Further, a starter (not shown) for starting the engine 1 is provided in the engine 1. A starter switch 57 for detecting the operation state is provided in the starter, and the starter switch 57 outputs a starter signal STA to the external input circuit 50.

For example, the starter switch 57 outputs the starter signal STA corresponding to "ON" when the switched position of the ignition switch 56 changes from an off position to a start position and the starter is operated (during a cranking), and outputs the starter signal STA corresponding to "OFF" when the switched position of the ignition switch 56 is returned from the start position to the on position after the start is completed.

Further, a wheel speed sensor 58 for detecting a rotational speed thereof, that is, a wheel speed NT is provided near a wheel (not shown) of the vehicle 2, and an output signal of the wheel speed sensor 58 is input to the external input circuit 50.

Next, a control procedure at a time of controlling the fuel pressure within the delivery pipe 16 will be described below with reference to a flow chart shown in FIG. 4. Each of the processes of "a fuel pressure control routine" shown in FIG.

4 is executed as an interrupt handling at a predetermined crank angle by the ECU 26.

The fuel pressure control in accordance with the present embodiment is characterized in that in the case where the temperature of each of the O-rings 20, 21 is low, a process of changing the fuel pressure in the delivery pipe 16 to a pressure lower than the pressure set on the basis of the operation state of the engine 1 (hereinafter, referred to as a fuel pressure restriction process) is executed for the purpose of preventing the fuel leakage due to reduction of the seal capacity.

When the process proceeds to the routine, the ECU 26 reads an engine rotational speed NE, a fuel injection amount Q, a fuel temperature THF and a fuel pressure PF in step 110. The fuel injection amount Q is calculated in a fuel injection control routine independent from the present routine, which is stored in the RAM 44. Next, the ECU 26 determines whether or not a fuel pressure restriction process execution flag XPLOW is "0" in step 112. The fuel pressure restriction process execution flag XPLOW is used to determine whether or not the "fuel pressure restriction process" mentioned above is under execution, and set to "1" when the control is executed.

In the case where the "fuel pressure restriction process" is not executed in step 112 (XPLOW="0"), the ECU 26 compares the fuel temperature THF with a lower limit temperature THFLOW in step 114.

The lower limit temperature THFLOW is used to determine whether or not the "fuel pressure restriction process" should be executed. The lower limit temperature THFLOW is predetermined by an experiment and stored in the ROM 42. In the case where the fuel temperature THF is lower than the lower limit temperature THFLOW, the temperature of each of the O-rings 20, 21 is low and the sealing capacity is reduced, so that it is determined that there is a risk of fuel leakage caused in a portion on which the O-rings 20, 21 are disposed.

In step 114, in the case where it is determined that the fuel temperature THF is equal to or more than the lower limit temperature THFLOW, the ECU 26 proceeds to step 116 as it is considered that there is no risk of fuel leakage as mentioned above.

In step 116, the ECU 26 calculates the target fuel pressure PFTRG on the basis of the engine rotational speed NE and the fuel injection amount Q. The target fuel pressure PFTRG, calculated on the basis of the engine rotational speed NE and the fuel injection amount Q as mentioned above, becomes a pressure most suitable for the operation state of the engine 1.

The ROM 42 stores function data defining a relation between the target fuel pressure PFTRG, the engine rotational speed NE and the fuel injection amount Q, and the ECU 26 refers to the function data when calculating the target fuel pressure PFTRG.

Meanwhile in step 114, if it is determined that the fuel temperature THF is lower than the lower limit temperature THFLOW, the ECU 26 proceeds to step 120 where the "fuel pressure restriction process" is executed. Then, the ECU 26 calculates the target fuel pressure PFTRG on the basis of the fuel temperature THF in step 122 after setting the fuel pressure restriction process executing flag XPLOW to "1" in step 120. The ROM 42 stores function data defining the target fuel pressure PFTRG and the fuel temperature THF, and the ECU 26 refers to the function data when calculating the target fuel pressure PFTRG. Further, the target fuel pressure PFTRG calculated on the basis of the fuel temperature THF in step 122 is always lower than the target fuel pressure PFTRG calculated on the basis of the engine rotational speed NE and the fuel injection amount Q in step 116 as mentioned above, that is, the pressure corresponding to the operation state of the engine 1.

Figure 5:
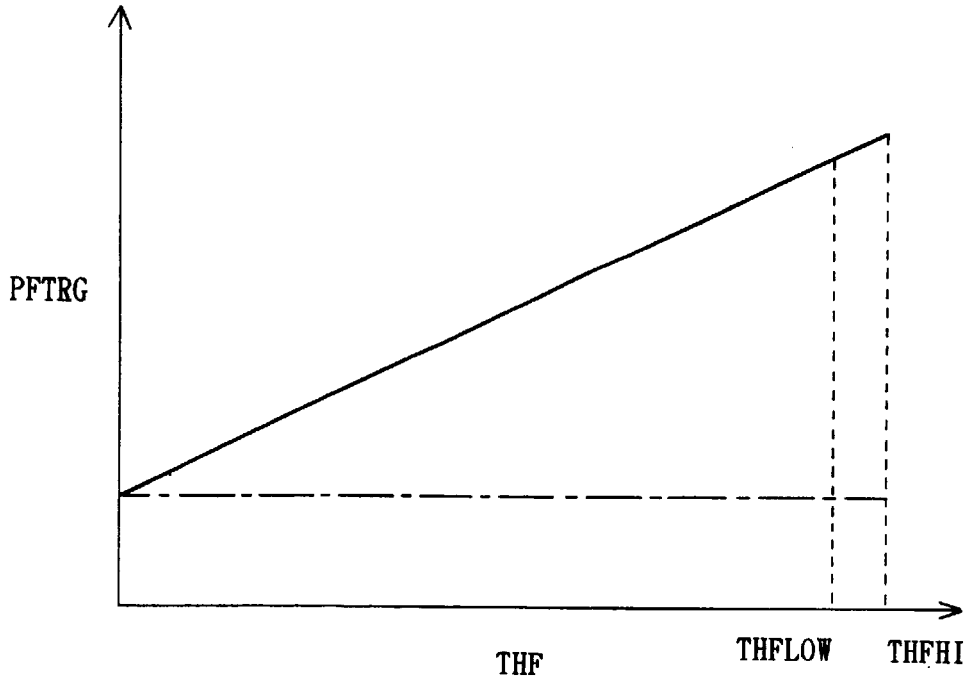
FIG. 5 is a graph showing a relation between fuel temperature and a target pressure fuel.

FIG. 5 is a graph showing a relation between the target fuel pressure PFTRG and the fuel temperature THF.

As shown by a solid line in FIG. 5, the target fuel pressure PFTRG is set lower as the fuel temperature THF becomes lower. The lower the fuel temperature THF is, the lower the temperature of the O-rings 20, 21 becomes. As the sealing capacity is reduced, it is necessary to securely prevent the fuel leakage by setting the target fuel pressure PFTRG to a lower.

In steps 122 or 116, after calculating the target fuel pressure PFTRG, the ECU 26 controls the supply pump 12 on the basis of the fuel pressure PF and the target fuel pressure PF in step 118. That is, in step 118, the ECU 26 controls the fuel pressure in the supply pump 12 by adjusting the pressure feed start timing such that the deviation between the fuel pressure PF and the target fuel pressure PFTRG is reduced. Thereafter, the ECU 26 temporarily completes the process in accordance with the present routine.

On the contrary, in the case where it is determined that the "fuel pressure restriction process" is under execution (XPLOW="1") in step 112, the ECU 26 compares the fuel temperature THF with the upper limit temperature THFHI in step 130.

The upper limit temperature THFHI is structured to determine whether or not the "fuel pressure restriction process" is completed, and the upper limit temperature THFHI is set to the temperature higher than the lower limit temperature THFLOW by a predetermined temperature and stored in the ROM 42.

In step 130, in the case where it is determined that the fuel temperature THF is equal to or less than the upper limit temperature THFHI, the ECU 26 executes the process in step 122 and subsequent steps so as to continuously execute the "fuel pressure restriction process". On the contrary, in step 130, in the case where it is determined that the fuel temperature THF is greater than the upper limit temperature THFHI, the ECU 26 proceeds to step 132 to complete the "fuel pressure restriction process". Then, the ECU 26 executes the process in step 116 and subsequent steps after setting the fuel pressure restriction process executing flag XPLOW to "0" in step 132. As mentioned above, in accordance with the fuel pressure control of the present embodiment, when the fuel temperature THF is lower than the lower limit temperature THFLOW and the "fuel pressure restriction process" is started, the "fuel pressure restriction process" is continuously executed until the fuel temperature THF exceeds the upper limit temperature THFHI.

As mentioned above, in accordance with the present embodiment, it is structured such that in the case where the fuel temperature THF having a mutual relation with the temperature of the O-rings 20, 21 is detected and the fuel temperature THF is lower than the lower limit temperature THFLOW, it is determined that the temperature of the O-rings 20, 21 becomes low and the sealing capacity thereof is also lowered, thus controlling the fuel pressure of the delivery pipe 16 to the pressure lower than the one obtained on the basis of the operation state of the engine 1.

On the contrary, it is structured such that in the case where the fuel temperature THF is equal to or more than the lower limit temperature THFLOW, it is determined that the sealing capacity of the O-rings 20, 21 is sufficiently great and the sealing property within the high pressure fuel pipe such as the delivery pipe 16, the high pressure fuel passage 14 is secured, thus increasing the fuel pressure in the delivery pipe 16 to the pressure on the basis of the operation state of the engine 1.

Accordingly, the fuel leakage due to reduction of the sealing capacity of the O-rings 20, 21 at a low temperature can be prevented while continuing to atomize the injected fuel.

In particular, in accordance with the present embodiment, it is structured such that the temperature of the O-rings 20, 21 is estimated on the basis of the fuel temperature within the delivery pipe 16, that is, the fuel temperature THF. Since the fuel within the delivery pipe 16 is directly brought into contact with the O-rings 20, 21, the temperature thereof has a high mutual relation with the temperature of the O-rings 20, 21.

Accordingly, it is possible to accurately estimate the sealing capacity of the O-rings 20, 21, which makes it possible to accurately determine the risk of fuel leakage on the basis of the estimated sealing capacity. As a result, it is possible to further securely prevent fuel leakage, and it is possible to avoid reduction of the atomized injected fuel due to an unnecessary execution of the "fuel pressure restriction process".

Further, in accordance with the present embodiment, it is structured such that in the case where the fuel temperature THF is lower than the lower limit temperature THFLOW, the fuel pressure in the delivery pipe 16 is not changed to a fixed pressure which is lower than the pressure which is based on the operation state, but the fuel pressure is changed in accordance with the fuel temperature THF.

For example, as shown by a single dot chain line in FIG. 5, even when the structure is made to control the target fuel pressure PFTRG to a sufficiently low fixed pressure in the case where the fuel temperature THF is less than the lower limit temperature THFLOW, it is possible to prevent fuel leakage caused by the reduction of the sealing capacity in the O-rings 20, 21. However, in accordance with the structure as mentioned above, since the fuel pressure in the delivery pipe 16 is kept at a low pressure even in the case where the fuel temperature THF is increased near to the lower limit temperature THFLOW, the atomization of the injected fuel is likely to be excessively restricted.

In this view, in accordance with the present embodiment, since it is structured such to adjust the fuel pressure within the delivery pipe 16 to the fuel temperature THF, that is, the pressure suitable for the reduced sealing capacity in the O-rings 20, 21, it is possible to intend to atomize the injected fuel as much as possible while securely preventing the fuel leakage.

Further, in accordance with the present embodiment, when the fuel temperature THF is lower than the lower limit temperature THFLOW and the "fuel pressure restriction process " is once started, the "fuel pressure restriction process" is continuously executed until the fuel temperature THF exceeds the upper limit temperature THFHF.

For example, if it is structured to start the "fuel pressure restriction process" when the fuel temperature THF is lower than the lower limit temperature THFLOW and complete the control when the fuel temperature THF is equal to or more than the lower limit temperature THFLOW, the target fuel pressure PFTRG is frequently switched between the pressure based on the engine rotational speed NE and the fuel injection amount Q and the pressure on the basis of the fuel temperature THF in the case where the fuel temperature THF is changed near to the lower limit temperature THFLOW. As a result, there is a risk that the control of the supply pump 12 becomes unstable.

In view of the above, in accordance with the present embodiment, since it is structured to provide a hysteresis in the temperature (THFLOW and THF) when the start timing and the complete timing of the "fuel pressure restriction process), it is possible to avoid the unstable control. It is, thus, possible to control the fuel pressure to a more stable state.

Next, a second embodiment will be described below focusing on the difference between the first and the second embodiments.

The present embodiment is different from the first embodiment in that the fuel temperature sensor 55 is omitted in the structure of the fuel supply apparatus. Further, in the fuel pressure control in accordance with the present embodiment, it is structured to detect the cooling water temperature THW in the engine 1 as the state having a mutual relation with the temperature of the O-rings 20, 21 so as to execute the "fuel pressure restriction process" as mentioned above on the basis of the cooling water temperature THW. Hereinafter, a control procedure of the fuel pressure will be described.

Figure 7:
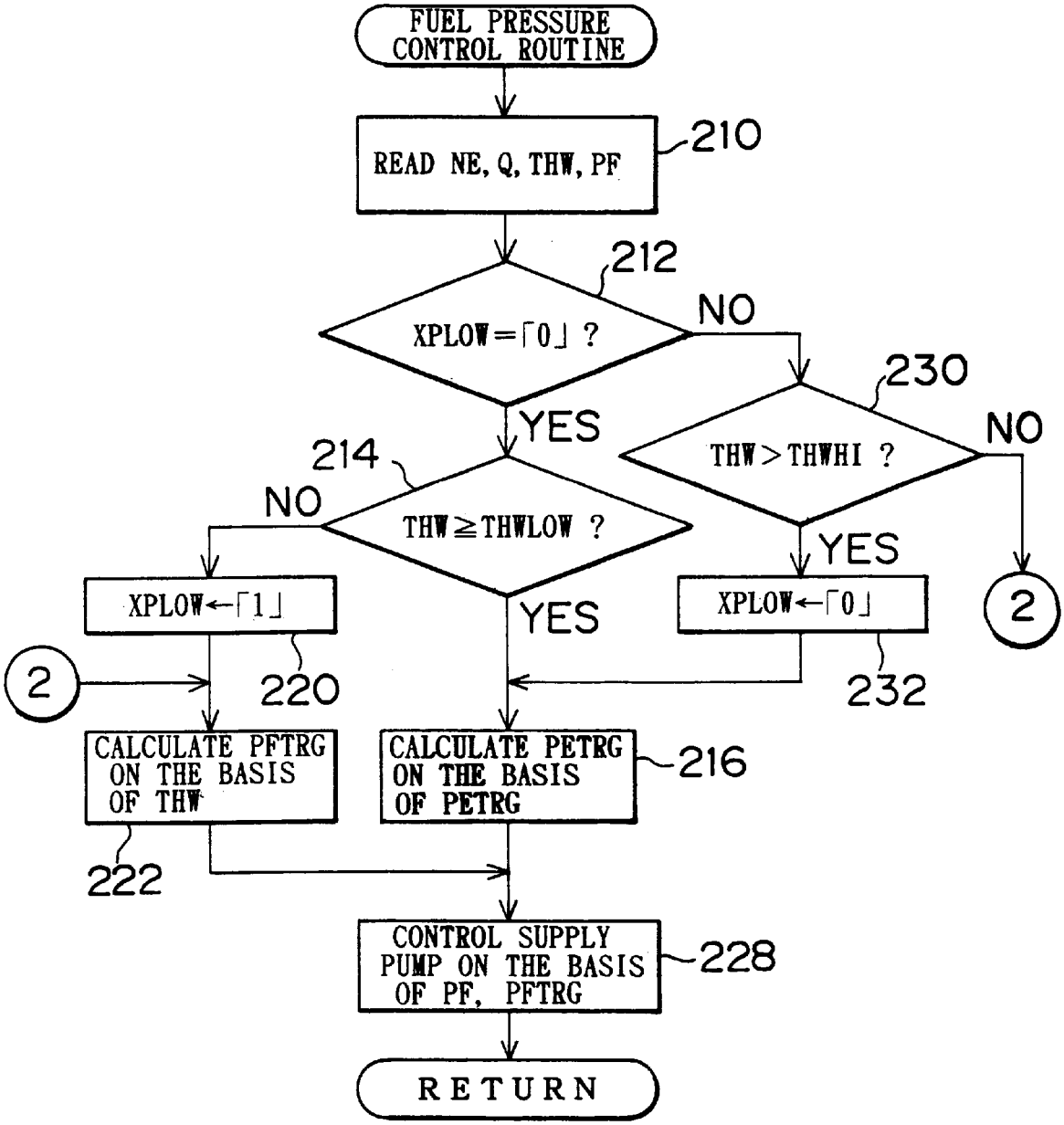
FIG. 7 is a flow chart representing a control procedure for fuel pressure in accordance with a second embodiment.

FIG. 7 is a flow chart representing each of the processes of the "fuel pressure control routine" in accordance with the present embodiment. The routine is executed as the interrupt handling per a predetermined crank angle by the ECU 26.

Figure 4:
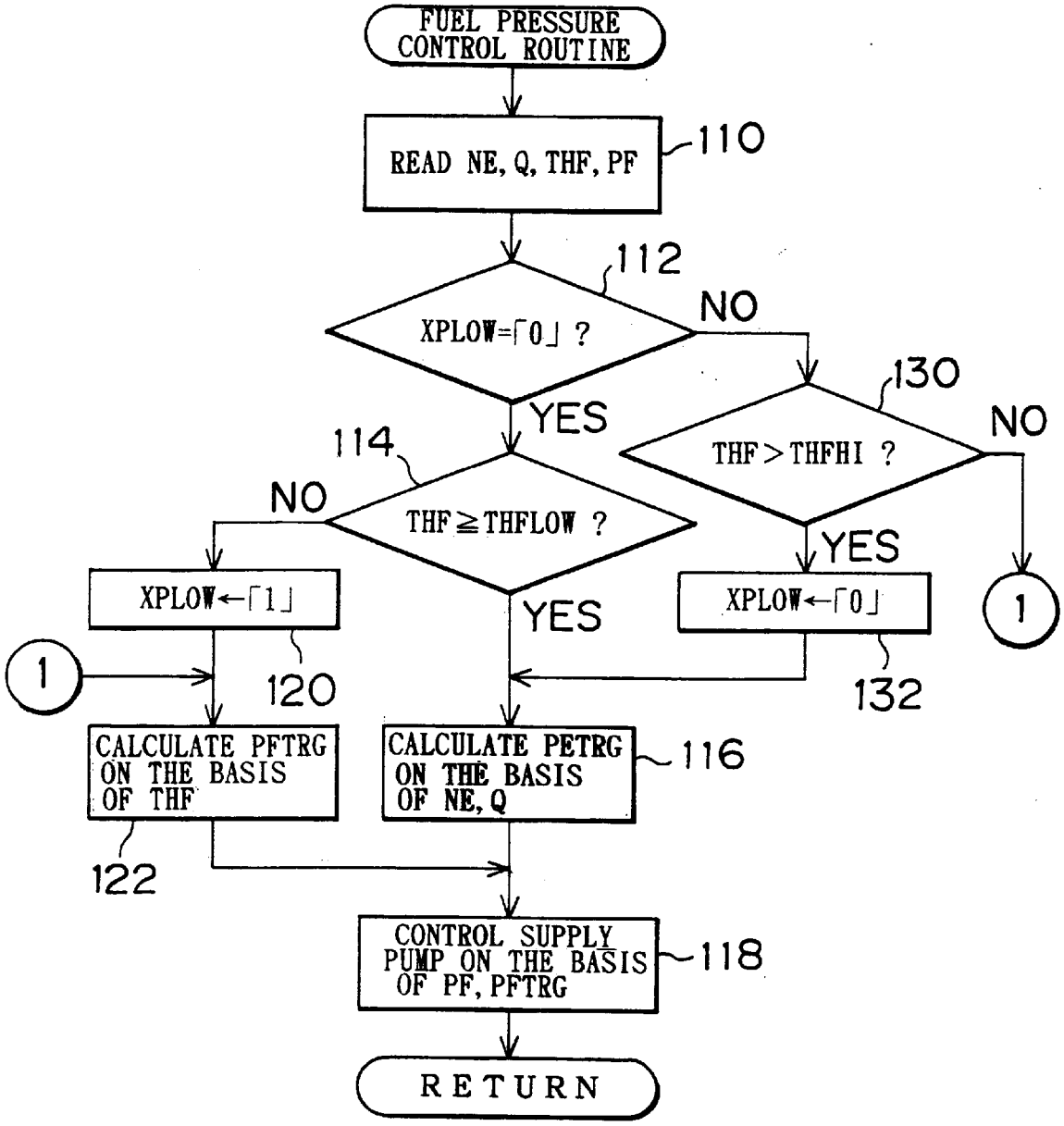
FIG. 4 is a flow chart representing a control procedure for fuel pressure in accordance with a first embodiment.

The difference between the process in the "fuel pressure control routine" in accordance with the present embodiment and the process in the "fuel pressure control routine" in accordance with the first embodiment shown in FIG. 4 is caused by the structure where the "fuel pressure restriction process" is executed on the basis of the cooling water temperature THW in place of the fuel temperature THF. Accordingly, only the different point will be described below.

In step 210, the ECU 26 reads the cooling water temperature THW in place of the fuel temperature THF. Then, in the case where it is determined that the "fuel pressure restriction process" is not executed (XPLOW "0") in step 212, the ECU 26 compares the cooling water temperature THW with the lower limit temperature THWLOW in step 214. The lower limit temperature THWLOW is used to determine whether or not the "fuel pressure restriction process" is executed in the same manner as that of the lower limit temperature THFLOW relating to the fuel temperature THF, which has been preliminarily determined by an experiment and stored in the ROM 42.

Then, in step 214, in the case where it is determined that the cooling water temperature THW is equal to or more than the lower limit temperature THWLOW, the ECU 26 calculates the target fuel pressure PFTRG on the basis of the engine rotational speed NE and the fuel injection amount Q in step 216. Meanwhile, in step 214, in the case where it is determined that the cooling water temperature THW is less than the lower limit temperature THWLOW, the ECU 26 calculates the target fuel pressure PFTRG on the basis of the cooling water temperature THW in step 222 after setting the fuel pressure restriction process executing flag XPLOW to "1" in step 220.

The ROM 42 stores function data defining a relation between the target fuel pressure PFTRG and the cooling water temperature THW, and the ECU 26 refers to the function data for calculating the target fuel pressure PFTRG.

Further, the target fuel pressure PFTRG on the basis of the cooling water temperature THW is calculated as the pressure which is always lower than the target fuel pressure PFTRG calculated on the basis of the engine rotational speed NE and the fuel injection amount Q (step 216), that is, the pressure corresponding to the operation state of the engine 1.

Figure 6:
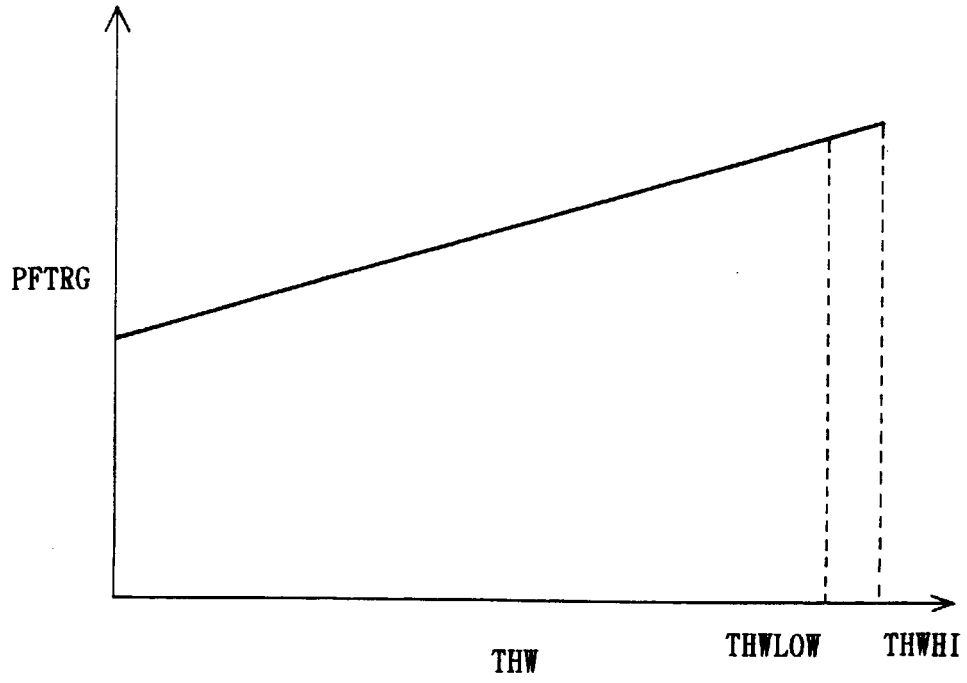
FIG. 6 is a graph showing a relation between cooling water temperature and the target fuel pressure.

FIG. 6 is a graph showing a relation between the cooling water temperature THW and the target fuel pressure PFTRG. Like the relation between the target fuel pressure PFTRG and the fuel temperature THF in accordance with the first embodiment, the target fuel pressure PFTRG is set to be lower as the cooling water temperature THW becomes lower. The lower the cooling water temperature THW is, the lower the temperature of the O-rings 20, 21 becomes, so the sealing capacity is deteriorated. It is necessary to securely prevent the fuel leakage by setting the target fuel pressure PFTRG lower.

On the contrary, in the case where it is determined that the "fuel pressure restriction process" is under execution in step 212, the ECU 26 compares the cooling water temperature THW with the upper limit temperature THWHI in step 230. The upper limit temperature THWHI is used to determine whether or not the "fuel pressure restriction process" is completed like the upper limit temperature THFHI relating to the fuel temperature THF, which is the temperature higher than the lower limit temperature THWLOW by a predetermined temperature and stored in the ROM 42.

Then, in step 230, in the case where it is determined that the cooling water temperature THW is equal to or less than the upper limit temperature THWHI, the ECU 26 executes the process in step 222 and subsequent steps so as to continuously execute the "fuel pressure restriction process". On the contrary, in step 230, in the case where it is determined that the cooling water temperature THW is greater than the upper limit temperature THWHI, the ECU 26 proceeds to step 232 where the "fuel pressure restriction process" is completed. Then, in step 232, the ECU 26 executes the process in step 216 and subsequent steps after setting the fuel pressure restriction process executing flag XPLOW to "0".

As mentioned above, in accordance with the present embodiment, it is structured such that in the case where the cooling water temperature THW having a mutual relation with the temperature of the O-rings 20, 21 is detected and the cooling water temperature THW is lower than the lower limit temperature THWLOW, it is determined that the temperature of the O-rings 20, 21 becomes low, thus reducing the sealing capacity thereof.

As a result, it is controlled such that the fuel pressure of the delivery pipe 16 is relatively lower on the basis of the operation state of the engine 1 (fuel pressure restriction process).

Further, it is structured to determine that the sealing capacity of the O-rings 20, 21 is reduced as the cooling water temperature THW becomes lower, thus controlling the fuel pressure in the delivery pipe 16 to a relatively lower pressure.

On the contrary, in the case where the cooling water temperature THW has been already equal to or more than the lower limit temperature THWLOW upon engine start or in the case where the cooling water temperature THW is increased from the temperature lower than the lower limit temperature THWLOW so as to be more than the upper limit temperature THWHI, the temperature of the O-rings 20, 21 is raised to enhance the sealing capacity sufficiently. As a result, it is determined that the sealing property within the high pressure fuel pipe such as the delivery pipe 16, the high pressure fuel passage 14 can be secured, thus increasing the fuel pressure in the delivery pipe 16 to the pressure on the basis of the operation state of the engine 1.

Accordingly, also in accordance with the present embodiment, the same effect as that described in the first embodiment can be obtained.

Further, in the present embodiment, it is structured to estimate the temperature of the O-rings 20, 21 on the basis of the cooling water temperature THW detected by the water temperature sensor 52. The water temperature sensor 52 is, for example, a preliminarily employed sensor as a general type for various kinds of controls in the engine 1, which is different from, for example, the fuel temperature sensor 55.

Therefore, in accordance with the present embodiment, the sensor for estimating the temperature of the O-rings 20, 21 is not required, thus simplifying the structure.

Next, a third embodiment will be described focusing on the difference between the first and the third embodiment.

The present embodiment is different from the first embodiment in that the fuel temperature sensor 55 is omitted in the structure of the fuel supply apparatus. Further, in the fuel pressure control in accordance with the present embodiment, it is structured to detect the elapsed time from engine start (hereinafter, refer to as "an elapsed time from start TSTART" in addition to the cooling water temperature THW and the lubricating oil temperature THO (hereinafter, respectively referred to as "a start water temperature THWST" and "a start oil temperature THOS") when the engine starts, as the state having a mutual relation with the temperature of the O-rings 20, 21 so as to execute the "fuel pressure restriction process" as mentioned above on the basis of each of the states THWS, THOS and TSTART.

In this case, each of the start water temperature THWS and the start oil temperature THOS is used to estimate the temperature of the O-rings 20, 21 when the engine starts. Further, the elapsed time from start TSTART is used to estimate the temperature increase amount of the O-rings 20, 21. The elapsed time from start TSTART is calculated by "routine for calculating an elapsed time from start" executed by the ECU 26 and is stored in the RAM 44.

Figure 8:
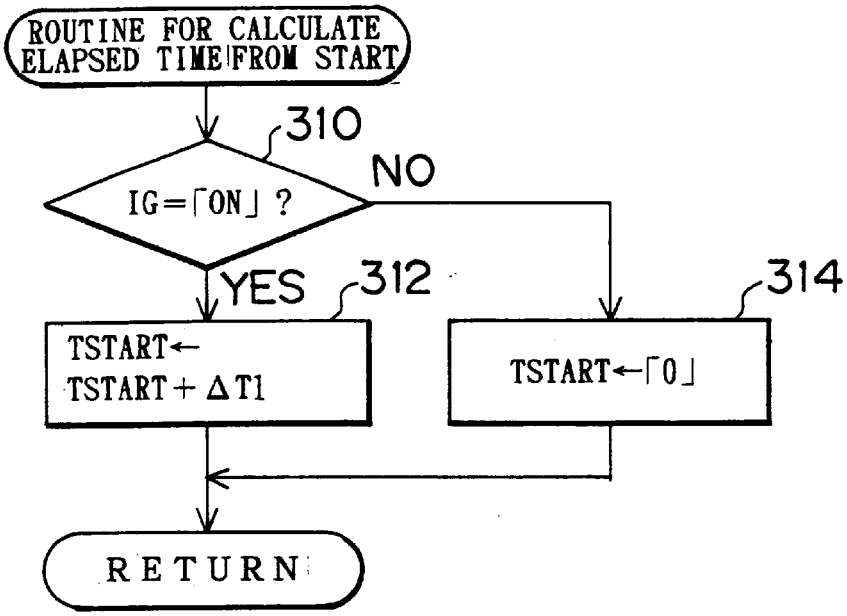
FIG. 8 is a flow chart which shows a calculation procedure for an elapsed time period from engine start.

Hereinafter, a calculating procedure of the elapsed time from start TSTART will be described below with reference to a flow chart shown in FIG. 8 showing each of the processes of the "routine for calculating the time from start". The routine is executed as an interrupt handling per a predetermined time by the ECU 26.

When the process proceeds to the routine, in step 310, the ECU 26 determines whether or not an ignition signal IG is "ON", that is, whether or not the engine 1 is operated or stopped. Here, in the case where it is determined that the ignition signal IG is in "ON" and the engine 1 is operated, the ECU 26 proceeds to step 312.

In step 312, the ECU 26 adds a predetermined time T1 to the current elapsed time from start TSTART to set the new elapsed time TSTART. In this connection, the predetermined time T1 is a time corresponding to an interruption period of the present routine.

On the contrary, in step 310, in the case where it is determined that the ignition signal IG is in "OFF", that is, in the case where it is determined that the engine 1 is stopped, the ECU 26 resets the elapsed time from start TSTART to "0" in step 314. Then, the ECU 26 temporarily completes the process in accordance with the present routine after executing the process in accordance with steps 312 and 314 as mentioned above.

Next, a fuel pressure control executed on the basis of the elapsed time after start START calculated in the manner mentioned above and the like will be described below.

Figure 10:
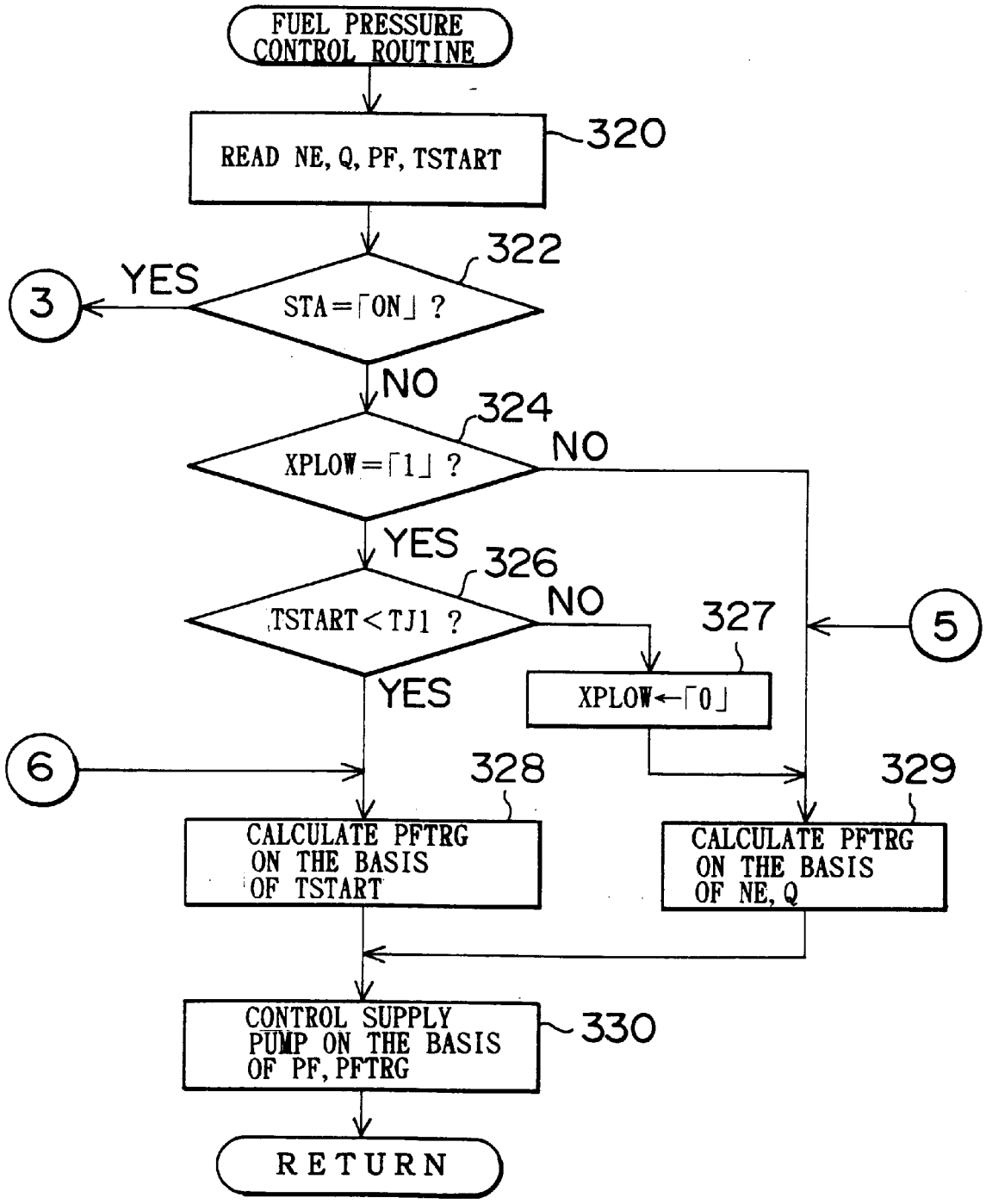
FIG. 10 is a flow chart representing a control procedure for fuel pressure in accordance with a third embodiment.
Figure 11:
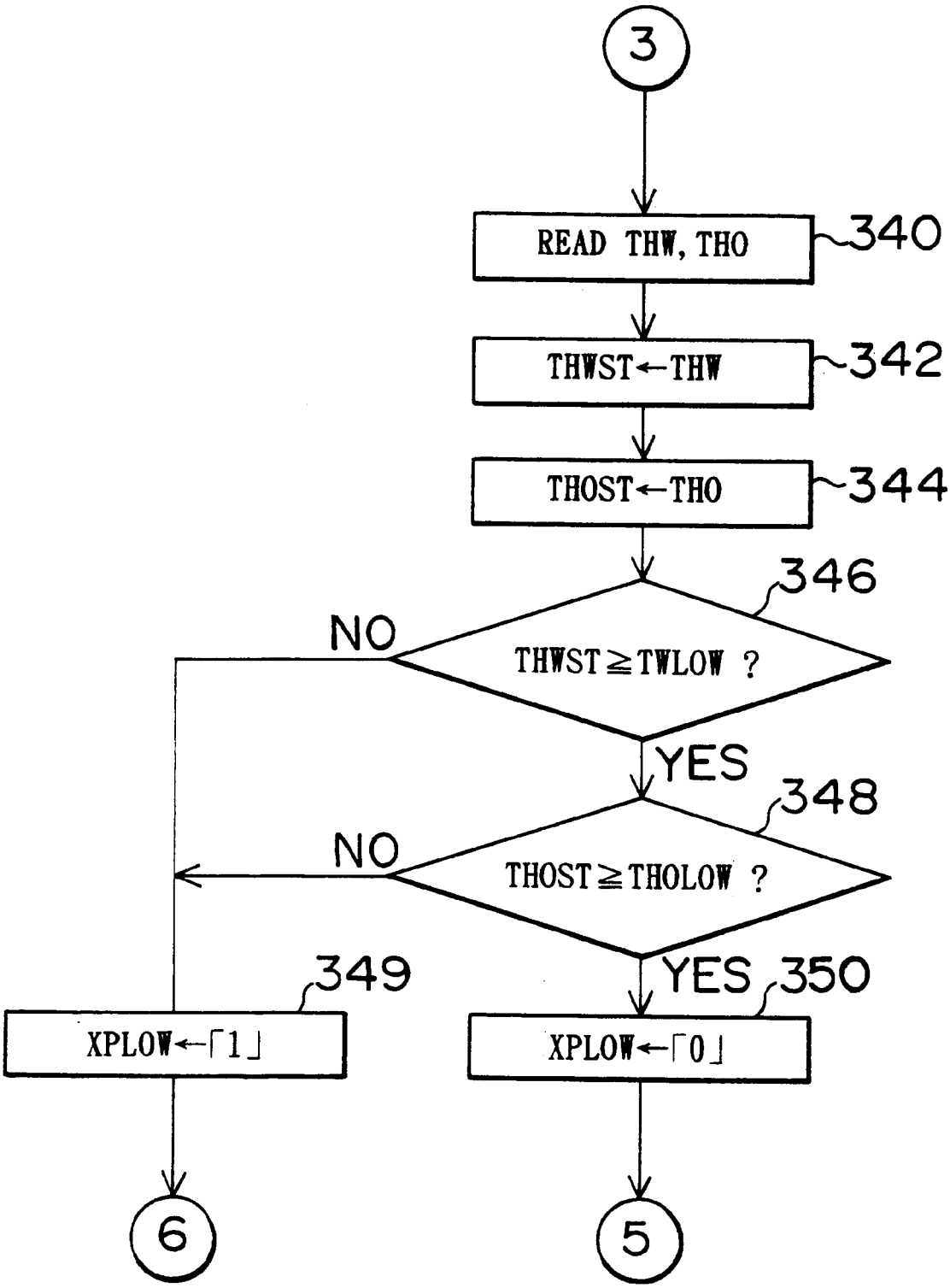
FIG. 11 is a flow chart representing a control procedure for fuel pressure in accordance with the third embodiment.

FIGS. 10 and 11 are flow charts showing each of processes of "a fuel pressure control routine" in accordance with the present embodiment. The routine is executed as an interrupt handling per a predetermined crank angle by the ECU 26.

When the process proceeds to the routine, the ECU 26 reads an engine rotational speed NE, a fuel injection amount Q, a fuel pressure PF, a starter signal STA and an elapsed time from start TSTART in step 320.

Next in step 322, the ECU 26 determines whether or not the starter signal STA is "ON", that is, whether or not the engine 1 is starting (during a cranking). Here, in the case where it is determined that the starter signal STA is "ON" and the engine 1 is starting, the ECU 26 proceeds to step 340 shown in FIG. 11.

In step 340, the ECU 26 reads the cooling water temperature THW and the lubricating oil temperature THO. Next, the ECU 26 sets the cooling water temperature THW as a start water temperature THWS in step 342, and sets the lubricating oil temperature THO as a start oil temperature THOS in step 344.

Then, the ECU 26 compares the start water temperature THWS with the lower limit temperature THFLOW as mentioned above in step 346. Here, in the case where it is determined that the start water temperature THWS is equal to or more than the lower limit temperature THWLOW, the ECU 26 proceeds to step 348.

In step 348, the ECU 26 compares the start oil temperature THOS with the lower limit temperature LOWOT. The lower limit temperature LOWOT is used to determine whether or not the "fuel pressure restriction process" is executed like the lower limit temperature THFLOW relating to the fuel temperature THF as mentioned above, which is predetermined and stored in the ROM 42.

In the case where the start oil temperature THOS is equal to or more than the lower limit temperature LOWOT in step 348, the ECU 26 determines that the temperature of the O-rings 20, 21 at engine start is high and there is no risk of fuel leakage caused by reduction of the sealing capacity, and then proceeds to step 350. Then, in step 350, the ECU 26 sets the fuel pressure restriction process executing flag XPLOW to "0" and proceeds to step 329 shown in FIG. 10.

In step 329, the ECU 26 calculates the target fuel pressure PFTRG on the basis of the engine rotational speed NE and the fuel injection amount Q like the process in accordance with step 116 shown in FIG. 4.

On the contrary, in step 346 shown in FIG. 11, in the case where it is determined that the start water temperature THWS is lower than the lower limit temperature THWLOW, or in the case where it is determined that the start oil temperature THOS is less than the lower limit temperature LOWOT in step 348, the ECU 26 determines that the temperature of the O-rings 20, 21 at engine start is low and there is a risk of fuel leakage caused by reduction of the sealing capacity, and proceeds to step 349. Then, in step 349, the ECU 26 sets the fuel pressure restriction process executing flag XPLOW to "1" and proceeds to step 328 shown in FIG. 10.

In step 328, the ECU 26 calculates the target fuel pressure PFTRG on the basis of the elapsed time from start TSTART. The ROM 42 stores function data defining a relation between the target fuel pressure PFTRG and the elapsed time from start TSTART, and the ECU 26 refers to the function data when calculating the target fuel pressure PFTRG. Further, the target fuel pressure PFTRG on the basis of the elapsed time from start TSTART is always lower than the target fuel pressure PFTRG calculated on the basis of the engine rotational speed NE and the fuel injection amount Q in step 329 as mentioned above.

Figure 9:
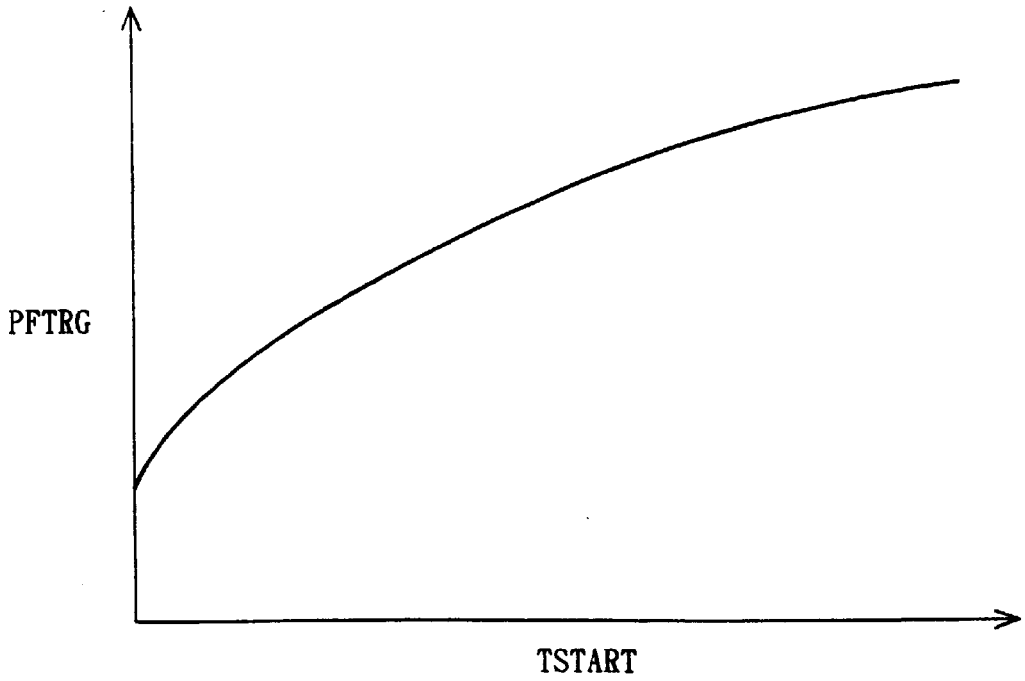
FIG. 9 is a graph showing a relation between an elapsed time from the start and the target fuel pressure.

FIG. 9 is a graph showing a relation between the target fuel pressure PFTRG and the elapse time start TSTART. As shown in FIG. 9 the target fuel pressure PFTRG is to be lower as the elapse time from start TSTART become shorter. The shorter the elapsed time from start TSTART is, the lower the temperature of the O-rings 20, 21, thus failing to secure sufficient sealing capacity. It is necessary to securely prevent fuel leakage by setting the target fuel pressure PFTRG to be lower.

On the contrary, in the case where it is determined that the starter signal STA is in "OFF" in step 322 shown in FIG. 10, the ECU 26 proceeds to step 324 as the engine 1 is not starting (during a cranking). In step 324, the ECU 26 determines whether or not the fuel pressure restriction process executing flag XPLOW is set to "1", that is, whether or not the "fuel pressure restriction process" is executing. Here, in the case where it is determined that the "fuel pressure restriction process" is not executed, the ECU 26 executes the process in step 329 and subsequent steps.

On the contrary, in step 324, in the case where it is determined that the "fuel pressure restriction process" is under execution, the ECU 26 proceeds to step 326 and compares the elapsed time from start TSTART with a judging time TJ1.

The judging time TJ1 is used to determine whether or not the "fuel pressure restriction process" should be completed, that is, whether or not the sealing capacity of the O-rings 20, 21 is sufficiently secured by the temperature increase thereof caused by the combustion heat within each of the cylinders generated after engine start, and is a preliminarily determined by an experiment and stored in the ROM 42.

In step 326, in the case where it is determined that the elapsed time from start TSTART is less than the judging time TJ1, the ECU 26 executes the process in step 328 and subsequent steps to continuously execute the "fuel pressure restriction process". On the contrary, in step 326, in the case where it is determined that the elapsed time from start TSTART is equal to or more than the judging time TJ1, the ECU 26 proceeds to step 327 to complete the "fuel pressure restriction process". Then, after setting the fuel pressure restriction process executing flag XPLOW to "0" in step 327, the ECU 26 executes the process in step 329 and subsequent steps.

As mentioned above, in accordance with the fuel pressure control of the present embodiment, when at least one of the start water temperature THWS and the start oil temperature THOS is lower than the lower limit temperatures THWLOW and LOWOT respectively corresponding thereto and once the "fuel pressure restriction process" is started, the "fuel pressure restriction process" is continuously executed until the time from start TSTART is more than the judging time TJ1.

After calculating the target fuel pressure PFTRG in step 328 or 329, the ECU 26 proceeds to step 380. Then, in step 330, after controlling the supply pump 12 on the basis of the fuel pressure PF and the target fuel pressure PFTRG, the ECU 26 temporarily completes the process in accordance with the present routine.

As mentioned above, in accordance with the present embodiment, it is structured such that after detecting the cooling water temperature THW (the start water temperature THWS), the lubricating oil temperature THO (the start oil temperature THOS) at engine start and the elapsed time from start TSTART which have a mutual relation with the temperature of the O-rings 20, 21 are detected. In the case where at least one of the start water temperature THWS and the start oil temperature THOS is lower than the lower limit temperatures THWLOW and the elapsed time from start TSTART is less than the judging time TJ1, it is determined that the temperature of the O-rings 20, 21 is low and the sealing capacity is reduced, thus controlling the fuel pressure in the delivery pipe 16 to be lower on the basis of the operation state of the engine 1.

Further, when controlling the fuel pressure in the delivery pipe 16 to a low pressure, the shorter the elapsed time from start TSTART is, the smaller the increase in the temperature of the O-ring 20, 21 becomes. So it is structured to control the fuel pressure in the delivery pipe 16 to a relatively low pressure by judging that the sealing capacity thereof is reduced.

On the contrary, in the case where both of the start water temperature THWS and the start oil temperature THOS are respectively higher than the lower limit temperatures THWLOW, or in the case any one of the start water temperature THWS and the start oil temperature THOS is less than the lower limit temperatures THWLOW and the elapsed time from start TSTART becomes equal to or more than the judging time TJ1, the sealing capacity of the O-rings 20, 21 has been already sufficiently high at engine start or the sealing capacity has been sufficiently high in accordance with the increase in the temperature of the O-rings 20, 21. So it is structured to set the fuel pressure in the delivery pipe 16 to the pressure on the basis of the operation state of the engine 1 by determining that the sealing capacity within the high pressure fuel pipe such as the delivery pipe 16 and the high pressure fuel passage 14 can be secured.

Therefore, also in accordance with the present embodiment, like the first embodiment as mentioned above, it is possible to prevent fuel leakage caused by reduction of the sealing capacity in the O-rings 20, 21 at a low temperature while continuing to atomize the injection fuel. Further, as it is structured to adjust the fuel pressure within the delivery pipe 16 to the pressure which is suitable for the fuel temperature THF, that is, the reduced sealing capacity of the O-rings 20, 21, it is possible to atomize the injected fuel as much as possible while securely preventing fuel leakage.

In this case, in view of determining that sufficient sealing capacity can be secured in the O-rings 20, 21, it is sufficient to simply determine that the elapsed time from start TSTART is equal to or more than the judging time TJ1 without estimating the temperature of the O-rings 20, 21 at engine start on the basis of the start water temperature THWS and the start oil temperature THOS. However, in accordance with this structure, in the case of restarting the engine after stopping the engine 1, there is a case that the "fuel pressure restriction process" is executed until the judging time TJ1 has passed while the temperature of the O-rings 20, 21 is high and sufficient sealing capacity can be secured.

In this view, in accordance with the present embodiment, in the case where both of the start water temperature THWS and the start oil temperature THOS are equal to or more than the lower limit temperatures THWLOW, that is, in the case where the sealing capacity of the O-rings 20, 21 has been already secured at the start, the "fuel pressure restriction process" is not executed even when the elapsed time from start TSTART is less than the judging time TJ1.

Accordingly, it is possible to avoid reducing the atomization of the injected fuel caused by execution of the unnecessary "fuel pressure restriction process".

Next, a fourth embodiment will be described below focusing on the different points from the third embodiment mentioned above.

In the third embodiment, it is structured to estimate the temperature increase of the O-rings 20, 21 after the engine starts on the basis of the elapsed time after engine start (the elapsed time from start TSTART), however, in the present embodiment, it is structured to estimate the temperature increase as mentioned above from an additional amount of fuel injection after engine start (hereinafter, referred to as "QSIGMA"). Then it is structured to determine a complete timing of the "fuel pressure restriction process" on the basis of the QSIGMA.

Figure 12:
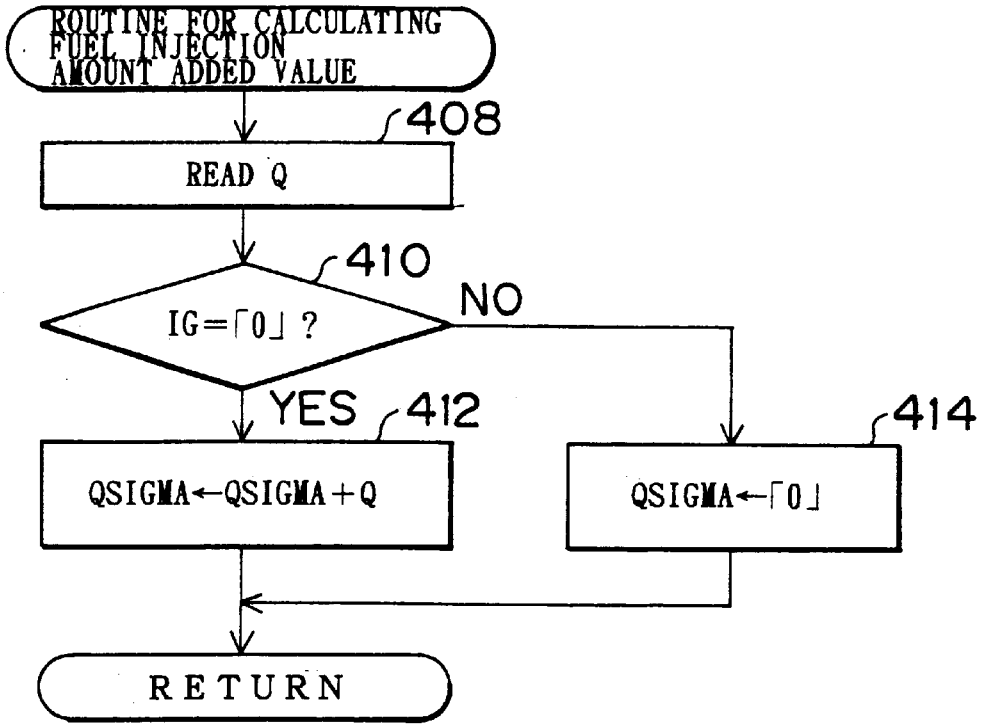
FIG. 12 is a flow chart representing a calculation procedure for an additional fuel injection amount.

Hereinafter, a procedure of calculating the QSIGMA will be described below with reference to a flow chart of FIG. 12 showing each of the processes of the "QSIGMA calculating routine". The routine is executed as an interrupt handling per a predetermined time by the ECU 26.

When the process proceeds to the routine, the ECU 26 reads the fuel injection amount Q in step 408. Next, in step 410, the ECU 26 determines whether or not the ignition signal IG is "ON". Here, in the case where it is determined that the ignition signal IG is "ON", the ECU 26 proceeds to step 412 as the engine 1 is operated.

In step 412, the ECU 26 adds the fuel injection amount Q read in step 408 to the current QSIGMA to set the new QSIGMA.

On the contrary, in the case where it is determined that the ignition signal IG is "OFF" in step 410, that is, in the case where the engine 1 is stopped, the ECU 26 resets the QSIGMA to "0" in step 414. After executing the process of steps 412 and 414, the ECU 26 temporarily completes the process of the present routine.

Next, a fuel pressure control executed on the basis of the QSIGMA and the like calculated as mentioned above will be described below.

Figure 14:
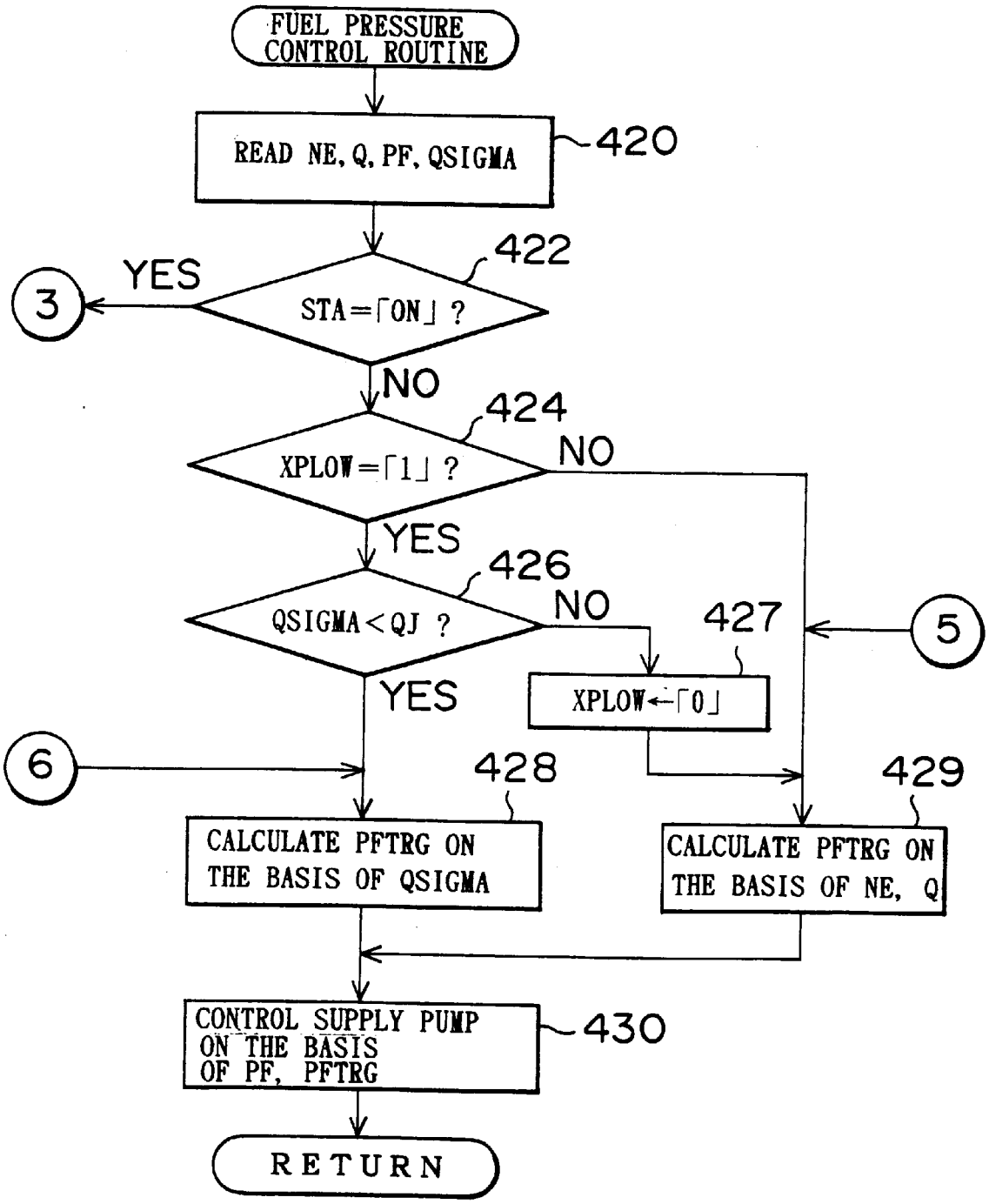
FIG. 14 is a flow chart representing a control procedure for fuel pressure in accordance with a fourth embodiment.

FIG. 14 is a flow chart showing each of the processes in the "fuel pressure control routine" in accordance with the present embodiment. The routine is executed as an interrupt handling per a predetermined crank angle by the ECU 26.

A difference between the process in the "fuel pressure control routine" in accordance with the present embodiment and the process in the "fuel pressure control routine" in accordance with the third embodiment shown in FIGS. 10 and 11 is based on the fact that the completion timing of the "fuel pressure restriction process" is determined on the basis of the QSIGMA in place of the elapsed time from start TSTART. Accordingly, only the different point will be described below.

In step 422, in the case where it is determined that the starter signal STA is "ON" and the engine 1 is under starting condition, the ECU 26 proceeds to step 340 shown in FIG. 11 and executes the process in step 340 and subsequent steps.

On the contrary, in the case where it is determined that the starter signal STA is "OFF" in step 422, the ECU 26 proceeds to step 424. Then, in step 424, when it is determined that the "fuel pressure restriction process" is under execution, the ECU 26 compares the QSIGMA that has been read in step 420 with the judging amount QJ in step 426.

The judging amount QJ is structured to determine whether or not the "fuel pressure restriction process" should be completed, that is, whether or not the sealing capacity of the O-rings 20, 21 is sufficiently secured by an increase in the temperature of the O-rings 20, 21 caused by the combustion heat within each of the cylinders generated after engine start, and is a predetermined and stored in the ROM 42.

In step 426, in the case where it is determined that the QSIGMA is less than the judging amount QJ, the ECU 26 proceeds to step 428 so as to continuously execute the "fuel pressure restriction process".

In step 428, the ECU 26 calculates the target fuel pressure PFTRG on the basis of the QSIGMA. The ROM 42 stores function data defining a relation between the target fuel pressure PFTRG and the QSIGMA, and the ECU 26 refers to the function data when calculating the target fuel pressure PFTRG. Further, the target fuel pressure PFTRG on the basis of the QSIGMA is calculated as a pressure which is always lower than the target fuel pressure PFTRG that is calculated on the basis of the engine rotational speed NE and the fuel injection amount Q in step 429, that is, the pressure corresponding to the operation state of the engine 1.

Figure 13:
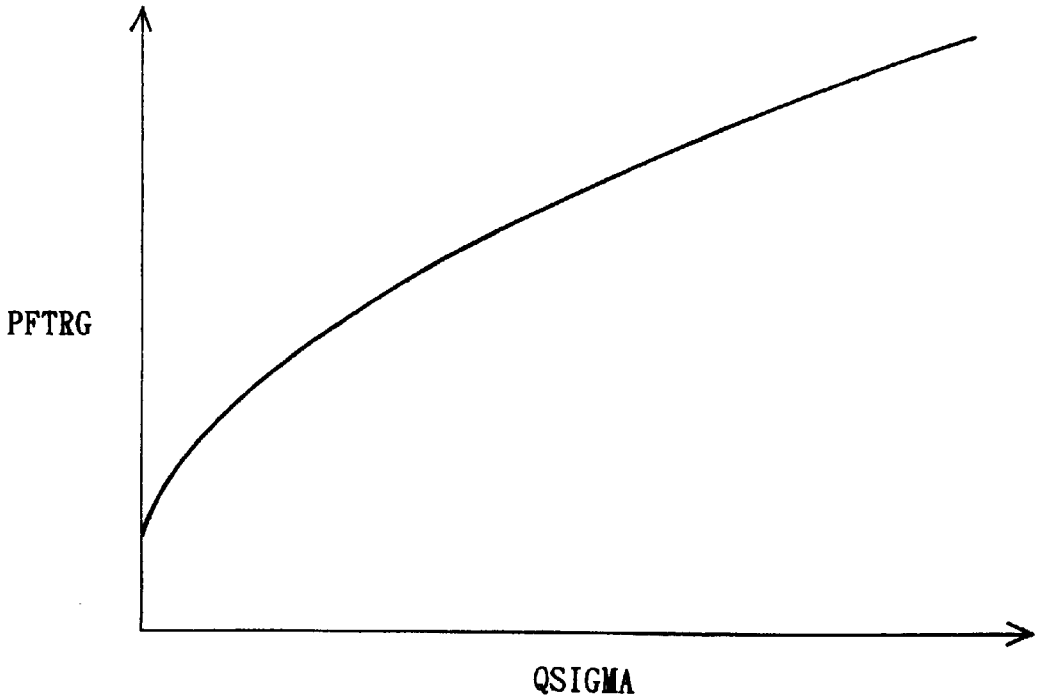
FIG. 13 is a graph showing a relation between the additional fuel injection amount and the target fuel pressure.

FIG. 13 is a graph showing a relation between the target fuel pressure PFTRG and the QSIGMA. As shown in FIG. 13, the target fuel pressure PFTRG is set to be lower as the QSIGMA becomes smaller like the elapsed time from start TSTART.

The less the QSIGMA is, the less the total combustion energy generated in each of the cylinders after the engine starts, and the received energy of the O-rings 20, 21 is reduced, such that the temperature increase of the O-rings 20, 21 becomes small. Accordingly, the temperature of the O-rings 20, 21 becomes low, and the sealing capacity thereof is going to be reduced. Therefore, it is structured to securely prevent fuel leakage by setting the target fuel pressure PFTRG to be lower when the QSIGMA is small.

After calculating the target fuel pressure PFTRG in step 428 or 429, the ECU 26 controls the supply pump 12 on the basis of the fuel pressure PF and the target fuel pressure PFTRG in step 430. Thereafter, the ECU 26 temporarily completes the process of the present routine.

Also in accordance with the present embodiment mentioned above, like the third embodiment, since it is possible to determine the completion timing of the "fuel pressure restriction process" after accurately recognizing the temperature increase of the O rings 20 and 21 after the engine starts on the basis of the QSIGMA so as to estimate the temperature of the O-rings 20, 21, it is possible to obtain the same operation and effect as those of the third embodiment.

In particular, the QSIGMA used for estimating the temperature increase of the O-rings 20, 21 in the present embodiment is structured to reflect the temperature increase more accurately than the elapsed time from the engine start (the elapsed time from start TSTART). This is because the temperature increase of the O-rings 20, 21 is changed in accordance with the total combustion energy generated in each of the cylinders after engine start even when the elapsed time is equivalent. Therefore, in accordance with the present embodiment, it is possible to determine the completion timing of the "fuel pressure restriction process" after recognizing the temperature increase of the O-rings 20, 21 more accurately.

Next, a fifth embodiment will be described below focusing on the point different from that of the second embodiment.

In a fuel pressure control in accordance with the present embodiment, it is structured to calculate a total time for which the engine 1 is operated (hereinafter, refer to as "an accumulated operation time TOTALT") and to inhibit execution of the "fuel pressure restriction process" after the accumulated operation time TOTALT reaches a predetermined time.

In accordance with the present embodiment, the accumulated operation time TOTALT is structured to estimate the sealing capacity of the O-rings 20, 21 at a low temperature. When the O-rings 20, 21 are brought into contact with the fuel, the fuel is going to permeate into an inner portion thereof for swelling. When the O-rings 20, 21 are swelled by the fuel as mentioned above, flexibility of the O-rings 20, 21 is increased, so that the sealing capacity at a low temperature will be increased.

Further, when the engine 1 is operated, the inner portion of the delivery pipe 16 is always filled with the fuel. Accordingly, it is possible to estimate a contact time between the O-rings 20, 21 and the fuel from the accumulated operation time TOTALT as mentioned above, and further, it is possible to estimate a swelling degree of the O-rings 20, 21 from the contact time, and further the sealing capacity can be estimated.

Figure 16:
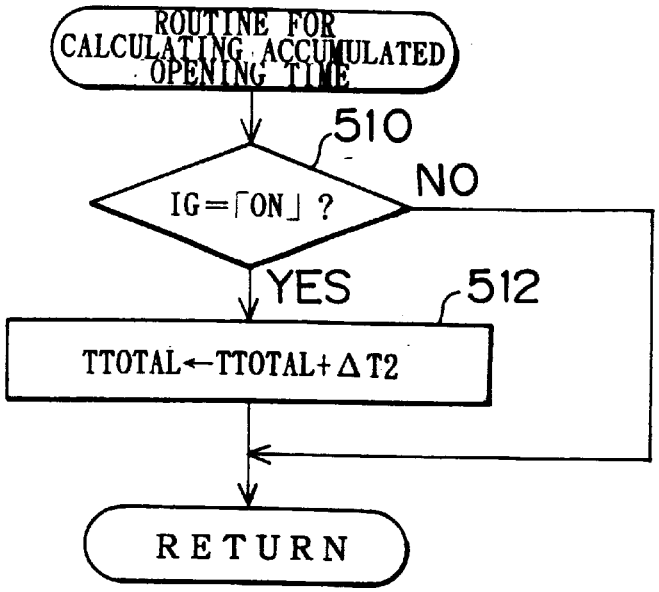
FIG. 16 is a flow chart representing a calculation procedure for an accumulated operation time.

A procedure of calculating the accumulated operation time TOTALT will be described below with reference to a flow chart shown in FIG. 16 which shows each of the processes in the "accumulated operation time calculation routine". The routine is executed as an interrupt handling per a predetermined time by the ECU 26.

When the process proceeds to the routine, in step 510, the ECU 26 determines whether or not the ignition signal IG is "ON", that is, whether the engine 1 is operated or stopped. Here, in the case where it is determined that the ignition signal IG is "ON", the ECU 26 move the process to step 512 after recognizing that the engine 1 is in an operation condition.

In step 512, the ECU 26 adds a predetermined time T2 to the current accumulated operation time TOTALT to set the new accumulated operation time TOTALT and stores the new TTOTAL in a back up memory 46. In this connection, the predetermined time T2 is a time corresponding to an interruption period of the present routine. Further, the accumulated operation time TOTALT is held in the back up memory 46 even after the engine stops.

After executing the process in accordance with step 512, or in the case where it is determined that the ignition signal IG is "OFF", the ECU 26 temporarily completes the process in accordance with the present routine.

Next, a fuel pressure control executed on the basis of the accumulated operation time TOTALT and the like calculated as mentioned above will be described below.

Figure 15:
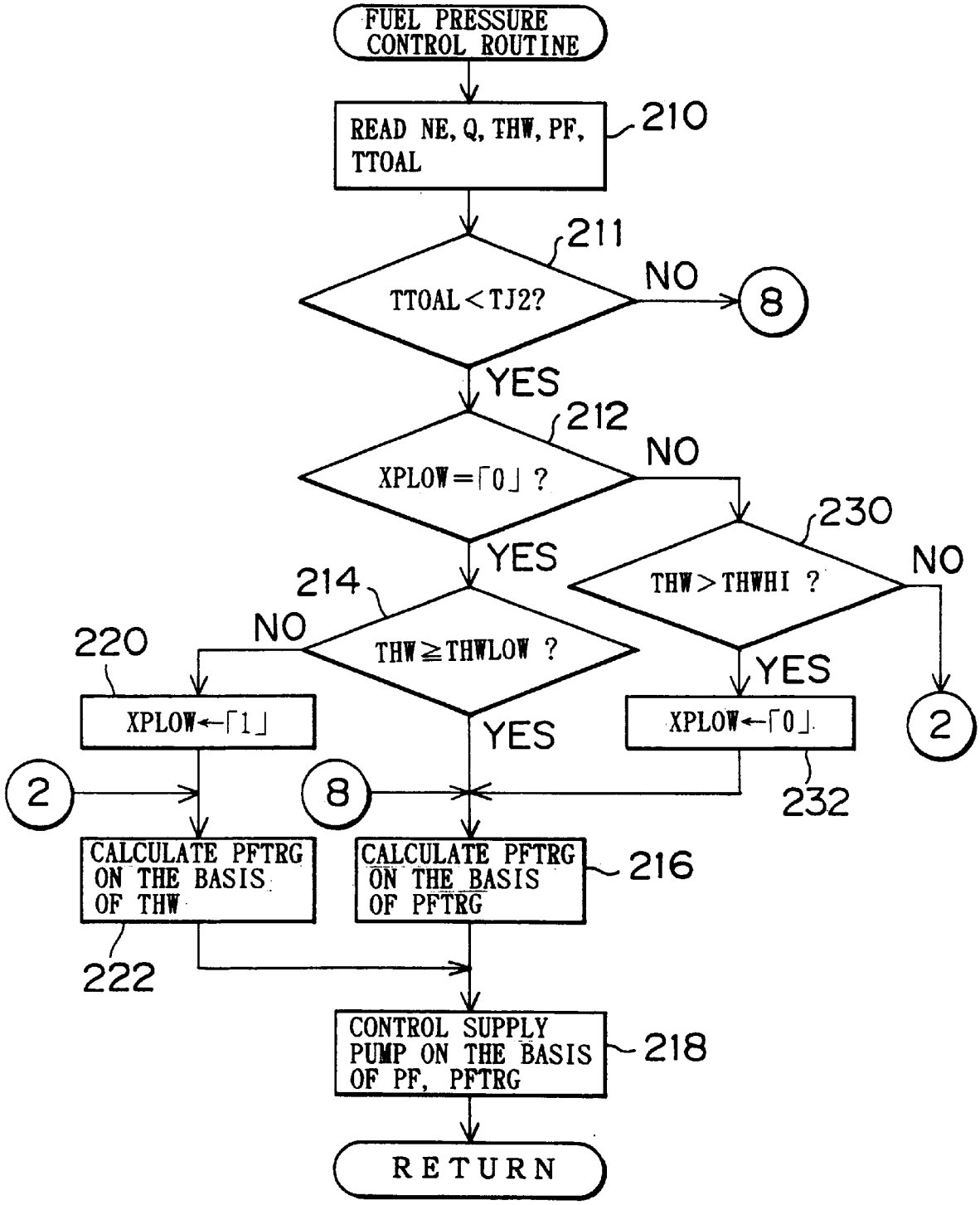
FIG. 15 is a flow chart representing a control procedure for fuel pressure in accordance with a fifth embodiment.

FIG. 15 is a flow chart showing each of the processes in the "fuel pressure control routine" in accordance with the present embodiment. The routine is executed as an interrupt handling per a predetermined crank angle by the ECU 26.

The "fuel pressure control routine" in accordance with the present embodiment is obtained by changing a part of the processes in the "fuel pressure control routine" in accordance with the second embodiment shown in FIG. 7. That is, after reading the accumulated operation time TOTALT in addition to the engine rotational speed NE, the fuel injection amount Q, the cooling water temperature THW and the fuel pressure PF, the ECU 26 proceeds to step 211.

In this step 211, the ECU 26 compares the accumulated operation time TOTALT with the judging time TJ2.

The judging time TJ2 is structured to determine whether or not execution of the "fuel pressure restriction process"

should be inhibited, and is experimentally predetermined and stored in the ROM 42. In the case where the accumulated operation time TOTALT is equal to or more than the judging time TJ2, it is determined that the swelling degree of each of the O-rings 20, 21 is great and it is possible to secure a sufficient sealing capacity even at a low temperature.

In step 211, in the case where it is determined that the accumulated operation time TOTALT is less than the judging time TJ2, that is, it is determined that the swelling degree of the O-rings 20, 21 does not reach a degree allowing for sufficient sealing capacity even at a low temperature, the ECU 26 successively executes the process in step 212 and the subsequent steps.

On the contrary, in step 211, in the case where it is determined that the accumulated operation time TOTALT is equal to or more than the judging time TJ2, the ECU 26 proceeds to step 216 where the "fuel pressure restriction process" is inhibited. Accordingly, irrespective of a magnitude of the cooling water temperature THW, the target fuel pressure PFTRG can be calculated as corresponding to the operation state of the engine 1 on the basis of the engine rotational speed NE and the fuel injection amount Q.

In accordance with the present embodiment as mentioned above, it is possible to obtain the same operation and effect as those of the second embodiment.

Further, in accordance with the present embodiment, in the case where the accumulated operation time TOTALT becomes equal to or more than the judging time TJ2, that is, in the case where the swelling degree of the O-rings 20, 21 becomes great and a sufficient sealing capacity can be secured even at a low temperature, execution of the "fuel pressure restriction process" will be inhibited even when the cooling water temperature THW becomes equal to or less than the lower limit temperature THWLOW.

Therefore, in accordance with the present embodiment, unnecessary reduction of the pressure PF of the fuel in the delivery pipe 16 can be avoided. As a result, it is possible to execute a fuel injection by the fuel pressure in correspondence to the operation state of the engine 1, thus securing a good combustion state of the engine 1.

Next, a sixth embodiment will be described below focusing on the point different from the second embodiment as mentioned above.

A fuel pressure control in accordance with the present embodiment is structured to calculate a target fuel pressure corresponding to the operation state (in the present embodiment, particularly referred to as "a basic target fuel pressure PFTRGB") on the basis of the engine rotational speed NE and the fuel injection amount Q for correcting the basic target fuel pressure PFTRGB in accordance with the cooling water temperature THW.

Figure 18:
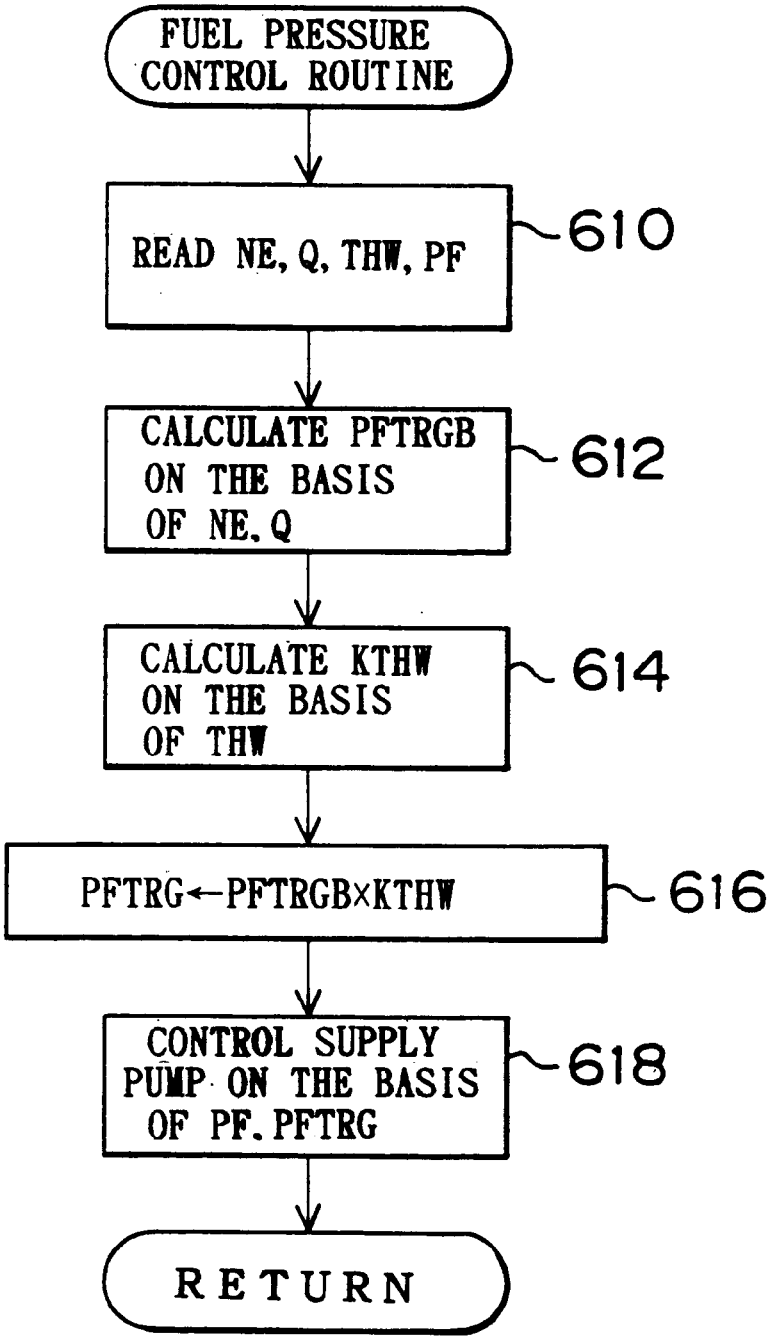
FIG. 18 is a flow chart representing a control procedure for fuel pressure in accordance with a sixth embodiment.

FIG. 18 is a flow chart showing each operation in the "fuel pressure control routine" in accordance with the present embodiment. The routine is executed as an interrupt handling per a predetermined crank angle by the ECU 26.

When the process proceeds to the routine, in step 610, the ECU 26 reads each of the engine rotational speed NE, the fuel injection amount Q, the cooling water temperature THW and the fuel pressure PF. Then, in step 612, the ECU 26 calculates a basic target fuel pressure PFTRGB on the basis of the engine rotational speed NE and the fuel injection amount Q.

Next, in step 614, the ECU 26 calculates a fuel pressure correction coefficient KWT on the basis of the cooling water temperature THW. The fuel pressure correction coefficient KWT is a coefficient for correcting the basic target fuel pressure PFTRGB as mentioned above in accordance with the cooling water temperature THW so as to prevent fuel leakage. The ROM 42 stores function data defining a relation between the fuel pressure correction coefficient KWT and the cooling water temperature THW, and the ECU 26 refers to the function data when calculating the target fuel pressure PFTRG.

Figure 17:
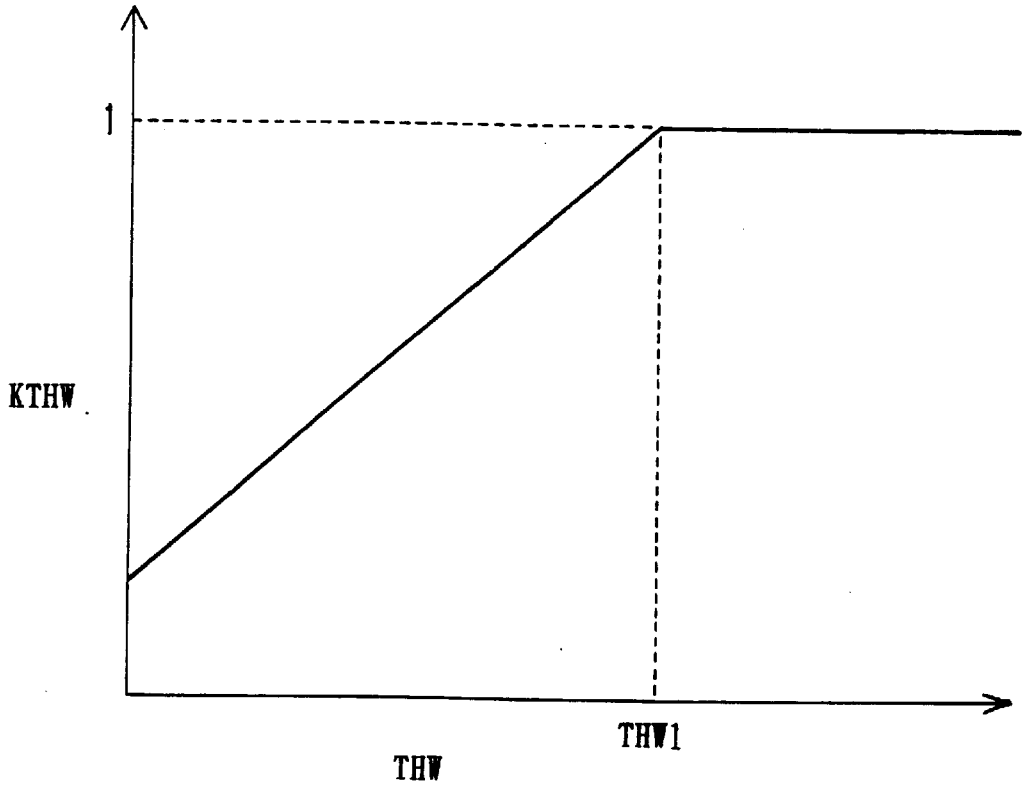
FIG. 17 is a graph showing a relation between cooling water temperature and a fuel pressure correction coefficient.

FIG. 17 is a graph showing the function data. As shown in FIG. 17, the fuel pressure correction coefficient KWT is calculated as "1" when the cooling water temperature THW is within a range equal to or more than a predetermined temperature THW1, and is smaller when the cooling water temperature THW is within a range lower than the predetermined temperature THW1.

Here, the predetermined temperature THW1 is structured to determine whether or not the "fuel pressure restriction process" should be executed like the lower limit temperature THWLOW as mentioned above, and is experimentally predetermined and stored in the ROM 42. That is, in the case where the cooling water temperature THW is lower than the predetermined temperature THW1, it is possible to determine that the temperature of each of the O-rings 20, 21 is high to secure sufficient sealing capacity.

Then, in step 616, the ECU 26 sets a new target fuel pressure PFTRG by multiplying the basic target fuel pressure PFTRGB by the fuel pressure correction coefficient KTHW. After calculating the target fuel pressure PFTRG as mentioned above, in step 618, the ECU 26 controls the supply pump 12 on the basis of the fuel pressure PF and the target fuel pressure PFTRG, and temporarily completes the process in accordance with the present routine.

In accordance with the present embodiment mentioned above, when the cooling water temperature THW is lower than the predetermined temperature THW1, the target fuel pressure PFTRG is set to be lower as the cooling water temperature THW is reduced. On the contrary, when the cooling water temperature THW is equal to or more than the predetermined temperature THW1, the fuel pressure correction coefficient KWT is set to "1", so that the target fuel pressure PFTRG is set to the pressure on the basis of the engine rotational speed NE and the fuel injection amount Q, that is, the pressure corresponding to the operation state of the engine 1.

Therefore, also in accordance with the present embodiment, it is possible to obtain the same operation and effect as those of the second embodiment.

Next, a seventh embodiment will be described below focusing on the point different from the fifth embodiment as mentioned above.

In a fuel pressure control in accordance with the present embodiment, it is structured to calculate a total traveling distance for which the vehicle provided with the engine 1 travels (hereinafter, referred to as an "accumulated traveling distance DTOTAL"), and inhibit execution of the "fuel pressure restriction process" after the accumulated traveling distance DTOTAL reaches a predetermined distance.

In accordance with the present embodiment, the accumulated traveling distance DTOTAL is used to estimate the sealing capacity of the O-rings 20, 21 at a low temperature in the same manner as that of the accumulated operation time TOTALT as mentioned above. That is, it is possible to estimate the contact time between the O-rings 20, 21 and the fuel from the accumulated traveling distance DTOTAL, and it is possible to estimate the swelling degree of the O-rings 20, 21, and further the sealing capacity from the contact time.

Figure 19:
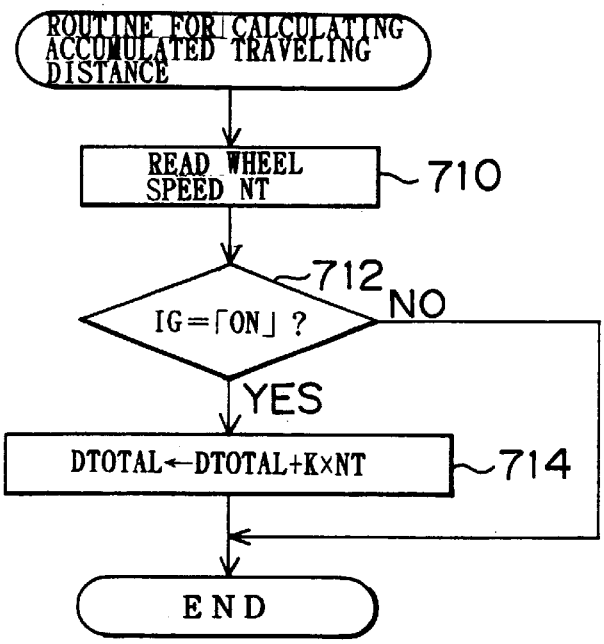
FIG. 19 is a flow chart representing a calculation procedure for an accumulated traveling distance in accordance with a seventh embodiment.

Hereinafter, a procedure of calculating the accumulated traveling distance DTOTAL will be described below with reference to a flow chart shown in FIG. 19 representing each of the processes in the "accumulated traveling distance calculating routine". The routine is executed as an interrupt handling per a predetermined time by the ECU 26.

At first, the ECU 26 reads a wheel speed NT on the basis of the output signal from the wheel speed sensor 58 in step 710. Next, the ECU 26 determines whether or not the ignition signal IG is "ON" and the engine 1 is in the operation state in step 712.

Here, when it is determined that the ignition signal IG is "ON", the ECU 26 calculates a traveling distance (K×NT) of the vehicle 2 per a unit time by multiplying the wheel speed NT by a predetermined constant K in step 714, and adding this to the accumulated traveling distance DTOTAL to set a new accumulated traveling distance DTOTAL, and thereafter, stores the new DTOTAL in the back up memory 46.

After renewing the accumulated traveling distance DTOTAL in the manner mentioned above, or in the case where it is determined that the ignition signal IG is "OFF" in step 712, the ECU 26 temporarily completes the process in accordance with the present routine.

Next, a fuel pressure control executed on the basis of the accumulated traveling distance DTOTAL calculated as mentioned above and the like will be described below.

Figure 20:
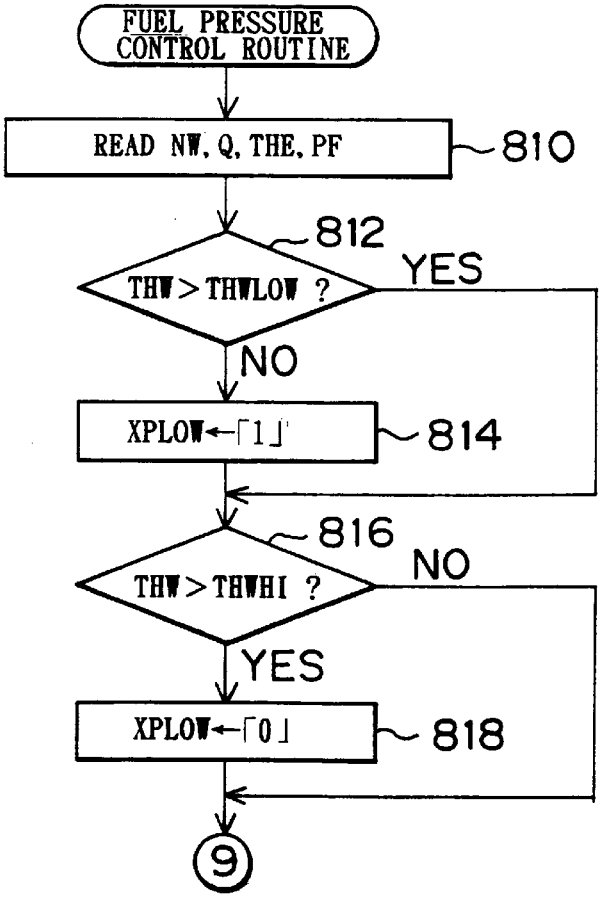
FIG. 20 is a flow chart representing a control procedure for fuel pressure in accordance with the seventh embodiment.
Figure 21:
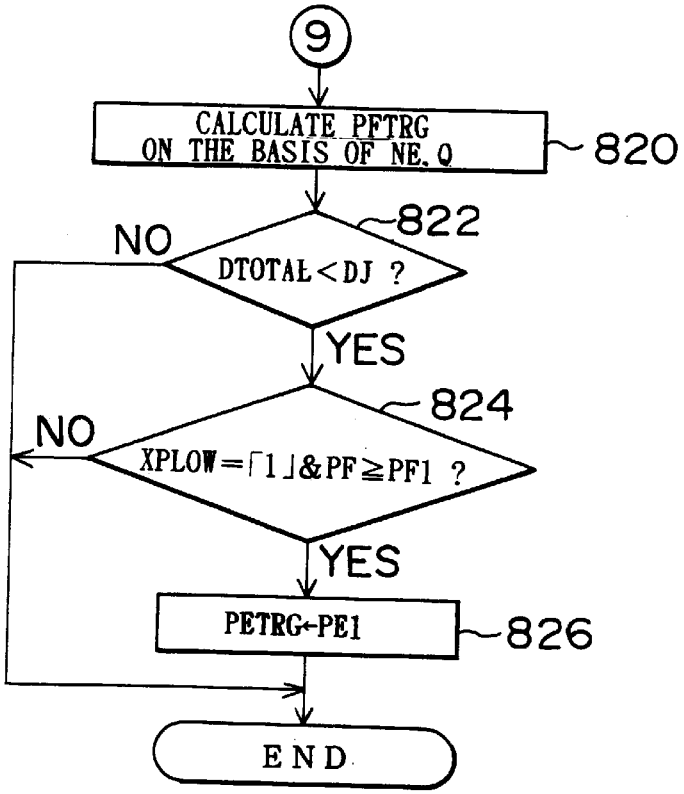
FIG. 21 is a flow chart representing a control procedure for fuel pressure in accordance with the seventh embodiment.

FIGS. 20 and 21 are flow charts which show each of the processes in a "fuel pressure control routine" in accordance with the present embodiment. The routine is executed as an interrupt handling per a predetermined crank angle by the ECU 26.

At first, the ECU 26 reads each of the engine rotational speed NE, the fuel injection amount Q, the cooling water temperature THW and the fuel pressure PF in step 810, and thereafter, compares the cooling water temperature THW with the lower limit temperature THWLOW in step 812. The lower limit temperature THWLOW is structured to determine whether or not the "fuel pressure restriction process" should be executed like the second embodiment.

In the case where it is determined that the cooling water temperature THW is equal to or less than the lower limit temperature THWLOW in step 812, the ECU 26 sets the fuel pressure restriction process executing flag XPLOW to "1" in step 814 so as to move the process to step 816. On the contrary, in the case that it is determined that the cooling water temperature THW is more than the lower limit temperature THWLOW in step 812, the ECU 26 proceeds to step 816 without executing the process in accordance with step 814.

In step 816, the ECU 26 compares the cooling water temperature THW with the upper limit temperature THWHI. The upper limit temperature THWHI is structured to determine whether or not the "fuel pressure restriction process" should be completed like the second embodiment, and is a predetermined temperature higher than the lower limit temperature THWLOW and stored in the ROM 42.

In the case where it is determined that the cooling water temperature THW is more than the upper limit temperature THWHI in step 816, the ECU 26 sets the fuel pressure restriction process executing flag XPLOW to "0" in step 818, and proceeds to step 820 shown in FIG. 21. On the contrary, in the case where it is determined that the cooling water temperature THW is equal to or less than the upper limit temperature THWHI in step 816, the ECU 26 proceeds to step 820 without executing the process in accordance with step 818.

In step 820, the ECU 26 calculates the target fuel pressure PFTRG on the basis of the engine rotational speed NE and the fuel injection amount Q. Then, in step 822, the ECU 26 compares the accumulated traveling distance DTOTAL with the judging distance DJ. The judging distance DJ is structured to determine whether or not execution of the "fuel pressure restriction process" should be inhibited like the judging time TJ2, and is experimentally predetermined and stored in the ROM 42. In the case where the accumulated traveling distance DTOTAL is more than the judging distance DJ, it is determined that the swelling degree of each of the O-rings 20, 21 is great, thus securing a sufficient sealing capacity even at a low temperature.

In the case where it is determined that the accumulated traveling distance DTOTAL is less than the judging distance DJ in step 822, that is, in the case where it is determined that the swelling degree of the O-rings 20, 21 that does not reach a degree at which the sufficient sealing capacity can be secured even at a low temperature, the ECU 26 determines whether or not the fuel pressure restriction process executing flag XPLOW is "1" and the fuel pressure PF is equal to or more than a predetermined pressure PF1 in step 824. The predetermined pressure PF1 is a fuel pressure capable of securely preventing fuel leakage even when the sealing capacity of the O-rings 20, 21 is reduced, and is set to a pressure lower than the target fuel pressure PFTRG calculated on the basis of the engine rotational speed NE and the fuel injection amount Q.

Here, if YES, the ECU 26 resets the target fuel pressure PFTRG to be equal to the predetermined pressure PF1 in step 826. On the contrary, in the case where it is determined that the accumulated traveling distance DTOTAL is equal to or more than the judging distance DJ in step 822, or if NO in step 824, the ECU 26 temporarily completes the process in accordance with the present routine. Accordingly, in this case, the target fuel pressure PFTRG is not reset, and the target fuel pressure PFTRG becomes a corresponding to the operation state of the engine 1 calculated in step 820.

In accordance with the present embodiment as mentioned above, in the case where the accumulated traveling distance DTOTAL is more than the judging distance DJ, that is, in the case where the swelling degree of the O-rings 20, 21 becomes great and sufficient sealing capacity can be secured even at a low temperature, execution of the "fuel pressure restriction process" will be inhibited even if the cooling water temperature THW is equal to or less than the lower limit temperature THWLOW.

Therefore, also in accordance with the present embodiment, the same effect as that of the fifth embodiment can be obtained.

Next, an eighth embodiment will be described below focusing on the different point from the seventh embodiment mentioned above.

In accordance with the present embodiment, it is structured to take into consideration a permeation speed when the fuel permeates into the O-rings 20, 21 when calculating the accumulated traveling distance DTOTAL.

Figure 22:
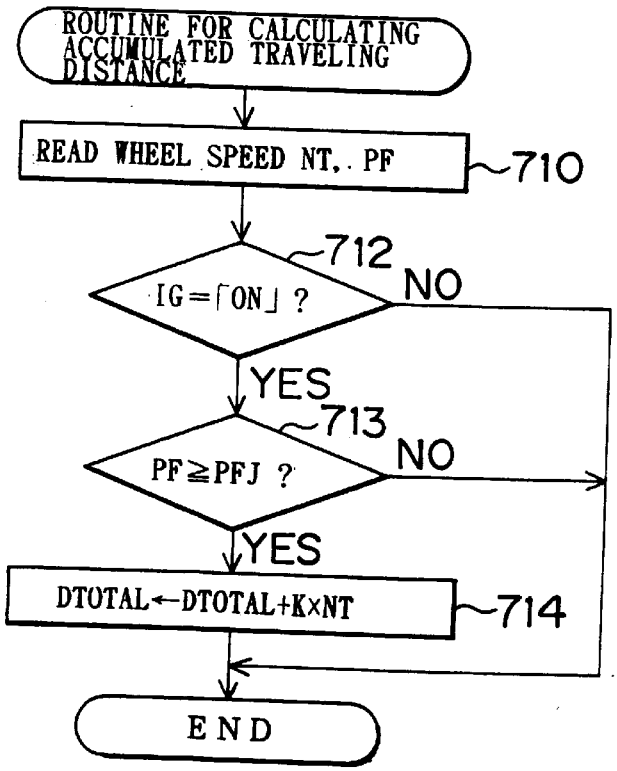
FIG. 22 is a flow chart representing a calculation procedure for an accumulated traveling distance in accordance with an eighth embodiment.

Hereinafter, a procedure of calculating the accumulated traveling distance DTOTAL will be described below with reference to a flow chart shown in FIG. 22. In this case, the "accumulated traveling distance calculating routine" is obtained by changing a part of the procedure in the "accumulated traveling distance calculating routine" shown in FIG. 19.

First, in step 710, the ECU 26 reads the wheel speed NT and the fuel pressure PF. When it is determined that the ignition signal IG is "ON" in step 712, the ECU 26 compares the fuel pressure PF with the judging pressure PFJ in step 713. The judging pressure PFJ is structured to determine that the permeation speed when the fuel permeates into the O-rings 20, 21 is equal to or more than the predetermined speed. In the case where the fuel pressure PF is equal to or more than the judging pressure PFJ, it is possible to determine that the fuel securely permeates into the O-rings 20, 21. In accordance with the present embodiment, only in the case where the fuel pressure PF is equal to or more than the judging pressure PFJ in step 713, the accumulated traveling distance DTOTAL is renewed.

As mentioned above, in accordance with the present embodiment, since it is structured to take into consideration the permeation speed of the fuel mentioned above when calculating the accumulated traveling distance DTOTAL, it is possible to calculate the accumulated traveling distance DTOTAL in such a manner as to further correspond to the swelling degree of the O rings 20 and 21.

Accordingly, it is possible to estimate the swelling degree of the O-rings 20, 21 in a more accurate manner, so that it is possible to further securely avoid the unnecessary reduction of the fuel pressure PF.

Next, a ninth embodiment will be described below focusing on the different point from the fifth embodiment mentioned above.

In accordance with the present embodiment, in order to reflect the permeation speed of the fuel to the accumulated operation time TOTALT, it is subjected to weighting on the basis of the fuel pressure PF so as to renew the accumulated operation time TOTALT.

Figure 23:
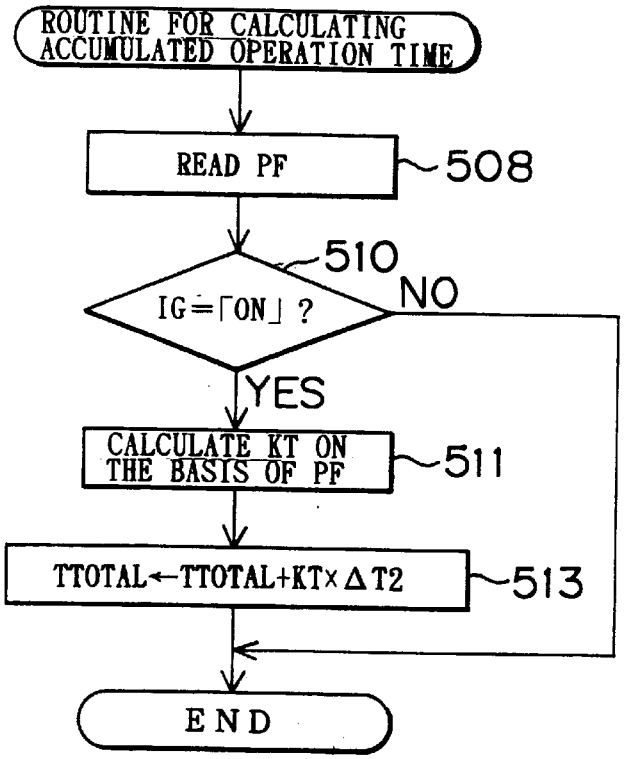
FIG. 23 is a flow chart representing a calculation procedure for an accumulated operation time accordance with a ninth embodiment.

Hereinafter, a procedure of calculating the accumulated operation time TOTALT will be described below with reference to a flow chart shown in FIG. 23. The "accumulated operation time calculating routine" shown in FIG. 23 is executed as an interrupt handling per a predetermined time by the ECU 26.

First, the ECU 26 determines whether or not the ignition signal IG is "ON" in step 510 after reading the fuel pressure PF in step 508. When it is determined that the ignition signal IG is "ON", the ECU 26 calculates a weighting factor KT on the basis of the fuel pressure PF in step 511. The weighting factor KT is used to renew after weighting the accumulated operation time TOTALT in accordance with the permeation speed when the fuel permeates into the O-rings 20, 21.

Figure 24:
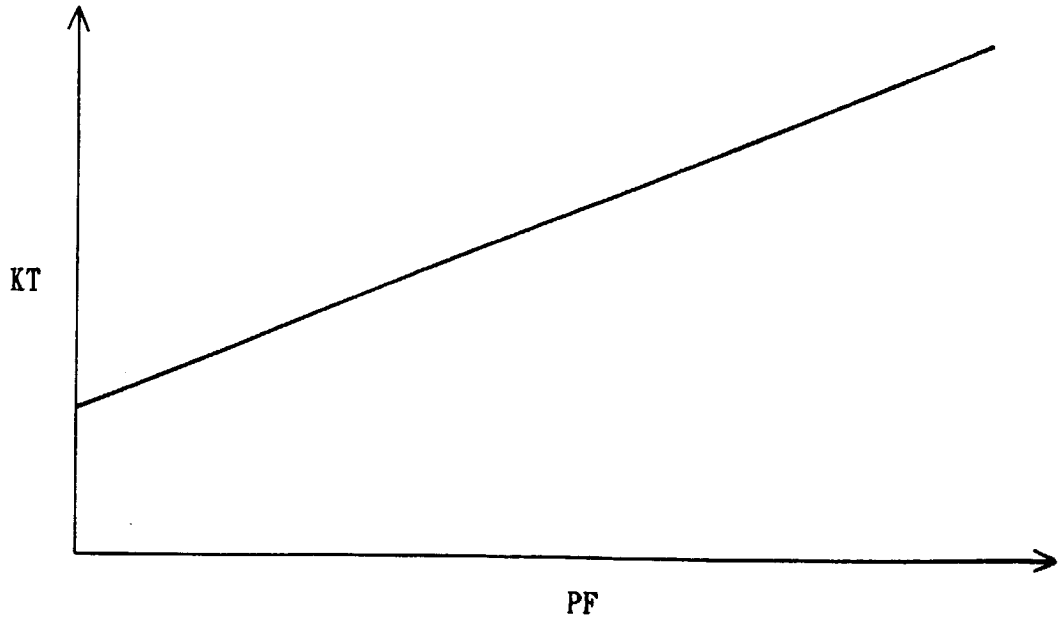
FIG. 24 is a graph showing a relation between fuel pressure and a weighting coefficient.

The ROM 42 stores function data defining a relation between the fuel pressure PF and the weighting factor KT as shown in FIG. 24, and the ECU 26 refers to the function data when calculating the weighting factor KT. As shown in FIG. 24, as the fuel pressure PF is increased, the weighting factor KT increases.

Next, the ECU 26 multiplies the predetermined time $\Delta T2$ corresponding to the interruption period of the present routine by the weighting factor KT, and adds the multiplied ($KT \times \Delta T2$) to the current accumulated operation time TOTALT in step 513. Then, the ECU 26 sets the added ($TOTALT + KT \times \Delta T2$) as a new accumulated operation time TOTALT, and temporarily completes the process in accordance with the present routine after storing the in the back up memory 46.

In accordance with the procedure of calculating the accumulated operation time TOTALT, in the case where the fuel pressure PF is high and the permeation speed of the fuel to the O-rings 20, 21 is high, the accumulated operation time TOTALT will be further increased, however, in the case where the fuel pressure PF is low and the permeation speed of the fuel is low, the accumulated operation time TOTALT will be slowly increased. As a result, the accumulated operation time TOTALT will be renewed by reflecting the change of the swelling degree in correspondence to the permeation speed of the fuel more accurately.

Therefore, in accordance with the present embodiment, it is possible to reflect an influence due to the permeation speed of the fuel substantially accurately, and it is possible to calculate the accumulated operation time TOTALT by the swelling degree of the O-rings 20, 21 as an accurate correspondence.

Next, a tenth embodiment will be described below focusing on the point different from the fifth embodiment as mentioned above.

In accordance with the fifth embodiment mentioned above, it is structured to estimate the swelling degree of the O-rings 20, 21 on the basis of the accumulated operation time TOTALT, however, the swelling degree of the O-rings 20, 21 is going to be returned to an initial state after the O-rings 20, 21 are replaced. Then, in accordance with the present embodiment, in the case where the O-rings 20, 21 are replaced, it is structured to initialize the accumulated operation time TOTALT to "0".

Figure 25:
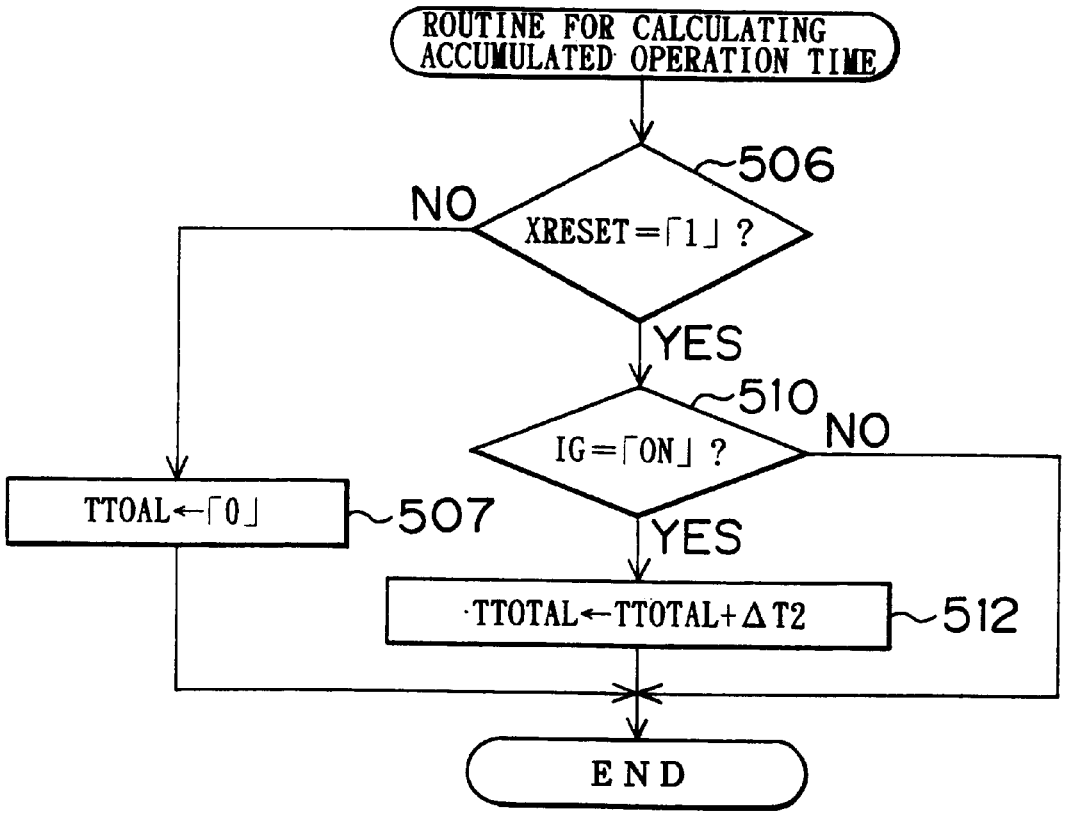
FIG. 25 is a flow chart representing a calculation procedure for an accumulated operation time in accordance with a tenth embodiment.

Hereinafter, a procedure of calculating the accumulated operation time TOTALT will be described below with reference to a flow chart shown in FIG. 25. In this case, in the flow chart shown FIG. 25, since the same processes as those of the flow chart shown in FIG. 16 are executed in step having the same reference numerals as those of the flow chart shown in FIG. 16, the explanation thereof will be omitted.

First, the ECU 26 determines whether or not the reset flag XRESET is "1" in step 506. The reset flag XRESET is a flag initialized to "0" when a harness electrically coupling the battery and the ECU 26 is removed and a power supply to the ECU 26 is all shut down.

Further, in the case where the O-rings 20, 21 are replaced, for example, when the injector 18 is replaced, the harness for coupling the battery and the ECU 26 is removed. Accordingly, in the case where the O-rings 20, 21 are replaced, the reset flag XRESET is always initialized to "0".

When it is determined that the reset flag XRESET is "1", the ECU 26 executes the process of steps 510 and 512 as mentioned above in step 506. On the contrary, when it is determined that the reset flag XRESET is "0" in step 506, the ECU 26 proceeds to step 507, and temporarily finishes the process in accordance with the present routine after initializing the accumulated operation time TOTALT to "0".

As mentioned above, in accordance with the present embodiment, since the accumulated operation time TOTALT is initialized to "0" when the O-rings 20, 21 are replaced, the fact that the swelling degree of the O-rings 20, 21 is returned to the initial state can be reflected to the estimation of the swelling degree.

Accordingly, even in the case where the replacing operation of the O-rings 20, 21 is performed, it is possible to accurately estimate the swelling degree of the O-rings 20, 21 in correspondence to the replacing operation thereof.

As mentioned above, each of the embodiments mentioned above can be modified in the following manner.

In the first and second embodiments as mentioned above, it is structured to detect the fuel temperature THF and the cooling water temperature THW having the mutual relation with the temperature of the O-rings 20, 21 and execute the "fuel pressure restriction process" on the basis of the fuel temperature THF and the cooling water temperature THW in order to estimate the sealing capacity of the O-rings 20, 21, however, the structure can be made to detect the lubricating oil temperature THO as the state of the engine 1 having the mutual relation with the temperature of the O-rings 20, 21 and execute the "fuel pressure restriction process" on the basis of the lubricating oil temperature THO. Further, in this case, like the relation between the target fuel pressure PFTRG and the cooling water temperature THW, the target fuel pressure PFTRG may be changed on the basis of the lubricating oil temperature THO, or may be set as a fixed.

In accordance with the third and fourth embodiments, it is structured such that the "fuel pressure restriction process" is executed when at least the start water temperature THWS and the start oil temperature THOS is less than the respective judging temperatures THWLOW, LOWOT and the elapsed time from start TSTART or the fuel injection amount added QSIGMA is less than the judging time TJ1 or judging amount QJ, however, the structure may be made such that, for example, the "fuel pressure restriction process" is executed when both of the start water temperature THWS and the start oil temperature THOS are less than the respective judging temperatures THWLOW and LOWOT.

Further, it is structured to detect only one of the start water temperature THWS and the start oil temperature THOS and execute the "fuel pressure restriction process" when the detected temperatures (THWS and THOS) are less than the judging temperatures (THWLOW and LOWOT).

Still further, the structure can be made to detect the fuel temperature when the engine starts (hereinafter, refer to as "a start fuel temperature THFST") and execute the "fuel pressure restriction process" when the fuel temperature ST at engine start is less than the judging temperature and the elapsed time from start TSTART or the fuel injection amount added QSIGMA is less than the judging time TJ1 or judging amount QJ.

In accordance with the third embodiment, when the elapsed time from start TSTART is less than the judging time TJ1 without relation to the start water temperature THWS and the start oil temperature THOS, the "fuel pressure restriction process" is always executed, and when the elapsed time from start TSTART becomes equal to or more than the judging time TJ1, the "fuel pressure restriction process" is completed.

Further, it is possible to set the judging time TJ1 to be shorter as the start water temperature THWS, the start oil temperature THOS or the start fuel temperature THFST becomes higher.

Further, in accordance with the fourth embodiment, when the additional fuel injection amount QSIGMA is less than the judging amount QJ without relation to the start water temperature THWS and the start oil temperature THOS, the "fuel pressure restriction process" is always executed, and when the additional fuel injection amount QSIGMA becomes equal to or more than the judging amount QJ, the "fuel pressure restriction process" is completed.

Further, it is possible to set the judging amount QJ to be smaller as the start water temperature THWS, the start oil temperature THOS or the start fuel temperature THFST becomes higher.

In accordance with the fourth embodiment, it is structured to estimate the temperature increase of the O-rings 20, 21 on the basis of the additional fuel injection amount QSIGMA, however, when the structure is made, for example, to add an intake air amount after engine start and estimate the temperature of the O-rings 20, 21 on the basis of the additional intake air amount (an additional intake air) in place of the additional fuel injection amount QSIGMA, the temperature increase of the O-rings 20, 21 after engine start can be estimated. Further, in the case of employing the structure as mentioned above, the structure can be made such that when the additional intake air is less than the judging amount without relation to the start water temperature THWS and the start oil temperature THOS, the "fuel pressure restriction process" is always executed, and when the additional intake air becomes equal to or more than the judging amount, the "fuel pressure restriction process" is completed. Further, in this case, it is possible to set the judging amount mentioned above to be smaller as the start water temperature THWS, the start oil temperature THOS or the start fuel temperature THFST becomes higher.

In accordance with the fifth embodiment, it is structured to inhibit execution of the "fuel pressure restriction process" when the accumulated operation time TTOTAL is equal to or more than the judging time TJ2, however, the structure can be made, for example, to change the lower limit temperature THWLOW and the upper limit temperature THWHI on the basis of the accumulated operation time TTOTAL.

Figure 26:
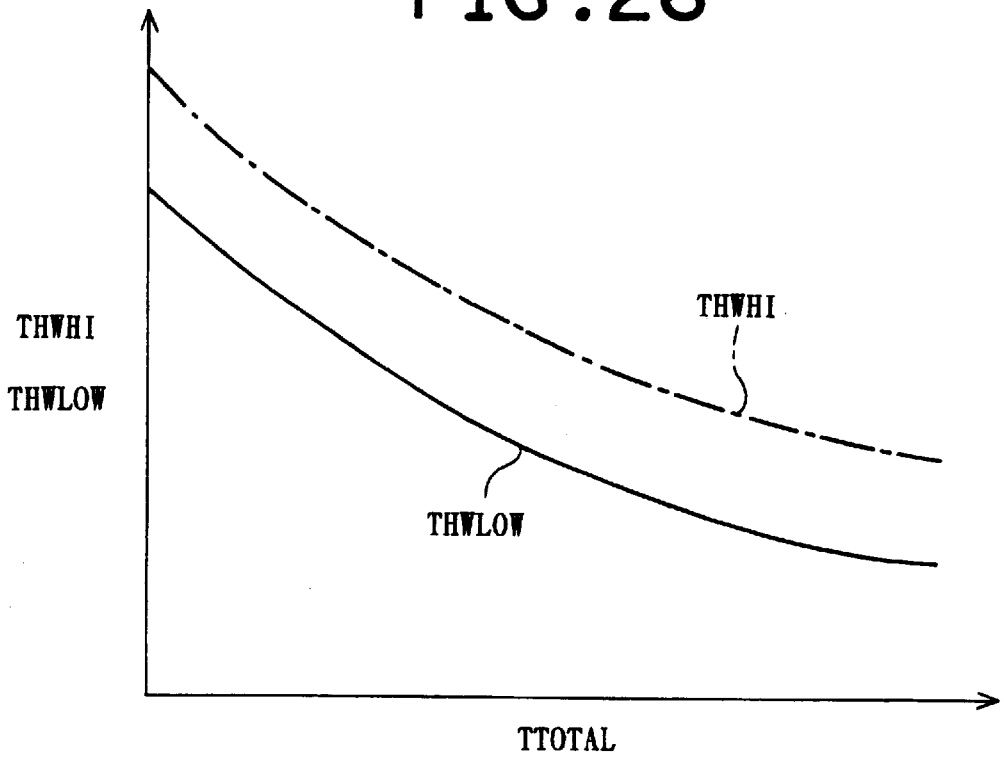
FIG. 26 a graph showing a relation between an accumulated operation time and each temperature in accordance with the other embodiment.

That is, the process in step 211 shown in FIG. 15 is changed to a process of "calculating each of the judging temperatures THWLOW and THWHI on the basis of the accumulated operation time TOTALT". When calculating each of the judging temperatures THWLOW and THWHI, function data defining a relation between the accumulated operation time TOTALT preliminarily stored in the ROM 42 and each of the judging temperatures THWLOW and THWHI is referred. Here, the relation between the accumulated operation time TOTALT and each of the judging temperatures THWLOW and THWHI is set such that each of the judging temperatures THWLOW and THWHI decrease as the accumulated operation time TOTALT becomes longer, for example, shown in a graph of FIG. 26. Further, in this case, the accumulated traveling distance DTOTAL may be employed in place of the accumulated operation time TOTALT.

Also in accordance with the structure as mentioned above, the same operation and effect as those of the fifth embodiment can be obtained.

Further, like the first embodiment, it is possible to calculate the accumulated operation time TOTALT and change each of the judging temperatures THFLOW and THFHI with respect to the fuel temperature THF on the basis of the accumulated operation time TOTALT.

In the third embodiment, it is possible to calculate the accumulated operation time TOTALT and change each of the judging temperatures THWLOW and HIOT with respect to the cooling water temperature THW (the start water temperature THWS), each of the judging temperatures LOWOT and HIOT with respect to the lubricating oil temperature THO (the start oil temperature THOS) and the judging time TJ1 with respect to the elapsed time from start TSTART on the basis of the accumulated operation time TOTALT.

In the fourth embodiment, it is possible to calculate the accumulated operation time TOTALT and change each of the judging temperatures THWLOW and HIOT with respect to the cooling water temperature THW (the start water temperature THWS), each of the judging temperatures LOWOT and HIOT with respect to the lubricating oil temperature THO (the start oil temperature THOS) and the judging amount QJ with respect to the QSIGMA on the basis of the accumulated operation time TOTALT.

Figure 27:
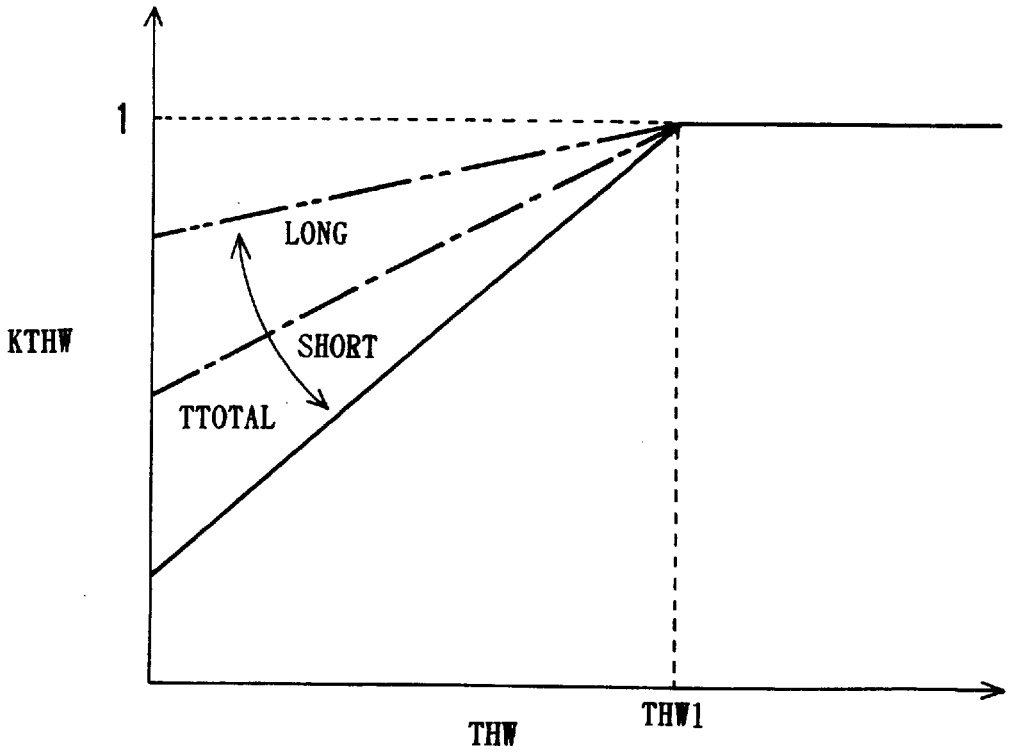
FIG. 27 is a graph showing a relation between cooling water temperature, and an accumulated operation time and a fuel pressure correction coefficient in accordance with the other embodiment.

In the sixth embodiment, it is possible to calculate the accumulated operation time TOTALT and set the fuel pressure correction coefficient KWT greater as the accumulated operation time TOTALT becomes longer, as shown in FIG. 27.

Further, in the structure described above, it is possible to employ the accumulated traveling distance DTOTAL in place of the accumulated operation time TOTALT.

In accordance with the fifth, seventh, eighth and ninth embodiments mentioned above, it is structured to detect the cooling water temperature THW as the state having a mutual relation with the sealing temperature of the O-rings 20, 21 and execute the "fuel pressure restriction process" when the cooling water temperature THW is less than the lower limit temperature THWLOW and the accumulated operation time TOTALT or the accumulated traveling distance DTOTAL is less than the judging time TJ2 and judging distance DJ, however, the structure may be made to always execute the "fuel pressure restriction process" when the cooling water temperature THW is less than the lower limit temperature THWLOW or the accumulated time TOTALT and accumulated distance DTOTAL are less than the judging time TJ2 and judging distance DJ.

Further, in this structure, it can be made to detect at least one of the fuel temperature THF, the lubricating oil temperature THO, the elapsed time from start TSTART, the QSIGMA and the additional intake air as the state having a mutual relation with the sealing capacity in place of the cooling water temperature THW.

Further, it is possible to estimate the state of the temperature of the O-rings 20, 21 on the basis that at least one of the start water temperature THWS, the start oil temperature THOS and the start fuel temperature THFST is lower than the corresponding judging temperature and at least one of the elapsed time from start TSTART, the QSIGMA and the additional intake air mentioned above is less than the corresponding judging values.

Further, in each of the structures, it is possible to set the judging temperature and the judging value on the basis of the accumulated operation time TOTALT and the accumulated traveling distance DTOTAL, or set the target fuel pressure PFTRG on the basis of the accumulated operation time TOTALT, the accumulated traveling distance DTOTAL, the fuel temperature THF, the lubricating oil temperature THO, the elapsed time from start TSTART, the QSIGMA and the additional intake air when executing the "fuel pressure restriction process".

In the sixth embodiment, the structure is made to set the basic target fuel pressure PFTRGB on the basis of the cooling water temperature THW, however, the structure may be made to set the basic target fuel pressure PFTRGB on the basis of at least one of the fuel temperature THF, the lubricating oil temperature THO, the elapsed time from start TSTART, the QSIGMA and the additional intake air in place of the cooling water temperature THW.

In the eighth embodiment, the structure may be made to measure the accumulated operation time TOTALT in place of the accumulated traveling distance DTOTAL, renew the accumulated operation time TOTALT when the fuel pressure PF is equal to or more than the judging pressure PFJ and inhibit the "fuel pressure restriction process" when the accumulated operation time TOTALT is more than the judging time TJ2.

In the ninth embodiment, the structure is made to weight on the basis of the fuel pressure PF and calculate the accumulated operation time TOTALT in order to reflect the permeation speed of the fuel to the accumulated operation time TOTALT, however, the structure may be made to weight the accumulated traveling distance DTOTAL in the similar manner for calculation.

In the tenth embodiment, the structure is made to initialize the accumulated operation time TOTALT on the basis of the reset flag XRESET, thereby corresponding to the replacement of the O-rings 20, 21, however, the structure may be made to initialize the accumulated traveling distance DTOTAL in the eight embodiment in the similar manner.

In each of the embodiments, the structure is made to control the pressure PF of the fuel within the delivery pipe 16 by the supply pump 12, however, the structure may be made, for example, to control the fuel pressure PF by changing the injection amount by means of the injector 18, or change the relief valve 28 to a control valve which can be opened and closed by the ECU 26 and open and close the relief valve 28 so as to control the fuel pressure PF.

In each of the embodiments, in order to estimate the sealing capacity of the 0rings 20, 21, the structure is made to calculate the fuel temperature THF, the cooling water temperature THW, the lubricating oil temperature THO, the elapsed time from start TSTART, the QSIGMA and the additional intake air as the state of the engine 1 having a mutual relation with the temperature of the O-rings 20, 21, however, it is possible to estimate the sealing capacity of the O-rings 20, 21 on the basis of an amount changing in relation to each of the states, for example, an increase fuel injection amount Q having a mutual relation with the cooling water temperature THW.

In each of the embodiments mentioned above, the structure is made such that the O-rings 20, 21 are arranged in the connection portion between the delivery pipe 16 and the injector 18, and the connection portion between the delivery pipe 16 and the fuel supply pipe 17 constituting the high pressure fuel passage 14, however, in addition thereto, for example, the structure may be made such that the O-rings are arranged in a mounting portion of the fuel pressure sensor 54 and the fuel temperature sensor 55 to the delivery pipe 16. As a result, fuel leakage from the mounting portion can be prevented.

In the aforementioned respective embodiments, as shown in FIG. 1, it is possible to estimate the temperature of the O-rings 20, 21 on the basis of the temperature detected by the temperature sensor 59 disposed on the surface of the delivery pipe 16 in the vicinity of the O-rings 20, 21. As a result, the cost required for the aforementioned estimation is substantially lower than the cost required for the direct detection of the fuel temperature, and further, providing high reliability especially in case of estimating the low temperature of the sealing portion.

What is claimed is:

1. A fuel supply apparatus for an internal combustion engine comprising:

a high pressure fuel pipe for supplying fuel pressurized by a high pressure fuel pump to an injector of an internal combustion engine;

a seal member for sealing a fuel transfer portion of the high pressure fuel pipe; and a fuel pressure controller for estimating a sealing capacity of the seal member and controlling fuel pressure within said high pressure fuel pipe on the basis of said estimated sealing capacity so that a predetermined sealing property can be maintained at the fuel transfer portion.

2. A fuel supply apparatus for an internal combustion engine according to claim 1, wherein the fuel pressure controller estimates the sealing capacity of the seal member on the basis of an estimation of the temperature of the seal member.

3. A fuel supply apparatus for an internal combustion engine according to claim 2, wherein the fuel pressure controller reduces the fuel pressure within the high pressure fuel pipe when the estimated temperature of the seal member does not reach a temperature capable of securing the sealing capacity of the seal member.

4. A fuel supply apparatus for an internal combustion engine according to claim 3, wherein the fuel pressure controller changes a rate for reducing the amount of the fuel within the high pressure fuel pipe on the basis of the estimated temperature of the seal member.

5. A fuel supply apparatus for an internal combustion engine according to claim 3, wherein the fuel pressure controller comprises a detector for detecting a state of the internal combustion engine having a mutual relation with respect to the temperature of the seal member and determination means for determining whether or not the condition is established on the basis of a comparison between the detected state and a predetermined value corresponding to the temperature capable of securing the sealing capacity of the seal member, thereby controlling so as to reduce the fuel pressure within said high pressure fuel pipe on the basis of the determination of the establishment of said condition by the determination means.

6. A fuel supply apparatus for an internal combustion engine according to claim 5, wherein the detector detects the temperature of the fuel within the high pressure fuel pipe as the state and the determination means determines an establishment of the condition when the detected temperature of the fuel is lower than a predetermined temperature corresponding to a determination.

7. A fuel supply apparatus for an internal combustion engine according to claim 5, wherein the detector detects a temperature of at least one of a cooling water and a lubricating oil of the internal combustion engine as said state and the determination means determines an establishment of the condition when the detected temperature is lower than a predetermined temperature corresponding to the determination.

8. A fuel supply apparatus for an internal combustion engine according to claim 5, wherein the detector detects an elapsed time from engine start as the state and the determination means determines an establishment of the condition when the detected elapsed time is shorter than a predetermined time corresponding to the determination.

9. A fuel supply apparatus for an internal combustion engine according to claim 5, wherein the detector detects an additional amount of fuel injected from the injector from engine start or an additional amount of inlet air supplied to the internal combustion engine after engine start as the state and the determination means determines an establishment of the condition when the detected additional amount is less than a predetermined amount corresponding to the determination.

10. A fuel supply apparatus for an internal combustion engine according to claim 8, wherein the detector further detects the temperature of the fuel within the high pressure fuel pipe at engine start or the temperature of at least one of the cooling water and the lubricating oil of the internal combustion engine at engine start as the state and the determination means determines an establishment of the condition when the detected temperature is lower than the predetermined temperature corresponding to the determination and the detected elapsed time is shorter than the predetermined time.

11. A fuel supply apparatus for an internal combustion engine according to claim 9, wherein the detector further detects the temperature of the fuel within the high pressure fuel pipe at engine start or the temperature of at least one of the cooling water and the lubricating oil of the internal combustion engine at engine start as the state and the determination means determines an establishment of the condition when the detected temperature is lower than the predetermined temperature corresponding to the determination and the detected additional amount is less than the predetermined amount.

12. A fuel supply apparatus for an internal combustion engine according to claim 5, wherein the detector detects a temperature of the surface of the fuel transfer portion of the high pressure fuel pipe and the determination means determines an establishment of the condition when the detected temperature is lower than the predetermined temperature corresponding to the determination.

13. A fuel supply apparatus for an internal combustion engine according to claim 1, wherein the fuel pressure control means estimates the sealing capacity of the seal member by an estimation of the temperature and the swelling degree of the seal member.

14. A fuel supply apparatus for an internal combustion engine according to claim 13, wherein the fuel pressure controller reduces the fuel pressure within the high pressure fuel pipe when the estimated temperature of the seal member does not reach the temperature capable of securing the sealing capacity of the seal member and the estimated swelling degree of the seal member does not reach the degree capable of securing the sealing capacity of the seal member.

15. A fuel supply apparatus for an internal combustion engine according to claim 13, wherein the fuel pressure controller reduces the fuel pressure within the high pressure fuel pipe when the estimated temperature of the seal member does not reach the temperature capable of securing the sealing capacity of the seal member or when the estimated swelling degree of the seal member does not reach the degree capable of securing the sealing capacity of the seal member.

16. A fuel supply apparatus for an internal combustion engine according to claim 5, wherein the fuel pressure controller estimates the sealing capacity of the seal member by estimating the swelling degree of the seal member in addition to an estimation of the temperature of the seal member, and further including an inhibitor that inhibits a control for reducing the fuel pressure within the high pressure fuel pipe when the estimated swelling degree of the seal member reaches a degree capable of securing the sealing capacity of the seal member.

17. A fuel supply apparatus for an internal combustion engine according to claim 5, wherein the fuel pressure controller estimates the sealing capacity of the seal member by estimating the swelling degree of the seal member in addition to an estimation of the temperature of the seal member, and further including a reduction rate changer for reducing the fuel pressure within the high pressure fuel pipe on the basis of the estimated swelling degree of the seal member.

18. A fuel supply apparatus for an internal combustion engine according to claim 5, wherein the fuel pressure controller estimates the sealing capacity of the seal member by estimating the swelling degree of the seal member in addition to an estimation of the temperature of the seal member, and further includes a judgment value setter that sets a judgment value on the basis of the estimated swelling degree of the seal member.

19. A fuel supply apparatus for an internal combustion engine according to claim 13, wherein the fuel pressure controller includes a time counter that counts an accumulated operation time of the internal combustion engine for estimating the swelling degree of the seal member on the basis of the accumulated operation time.

20. A fuel supply apparatus for an internal combustion engine according to claim 13, wherein the fuel pressure controller includes a measurer for measuring an accumulated traveling distance of the vehicle on which the internal combustion engine is mounted so as to estimate the swelling degree of the seal member on the basis of the measured accumulated traveling distance.

21. A fuel supply apparatus for an internal combustion engine according to claim 19, wherein the time counter changes a mode for time counting the accumulated operation time on the basis of the fuel pressure within the high pressure fuel pipe.

22. A fuel supply apparatus for an internal combustion engine according to claim 20, wherein the measurer changes a mode for measuring the accumulated traveling distance on the basis of the fuel pressure within the high pressure fuel pipe.

23. A fuel supply apparatus for an internal combustion engine according to claim 21, wherein the time counter counts the accumulated operation time when the fuel pressure within the high pressure fuel pipe is equal to or more than a predetermined pressure.

24. A fuel supply apparatus for an internal combustion engine according to claim 22, wherein the measurer measures the accumulated traveling distance when the fuel pressure within the high pressure fuel pipe is equal to or more than a predetermined pressure.

* * * * *